US010208558B2

(12) United States Patent
Meek et al.

(10) Patent No.: US 10,208,558 B2
(45) Date of Patent: Feb. 19, 2019

(54) POWER PUMPING SYSTEM AND METHOD FOR A DOWNHOLE TOOL

(71) Applicant: Schlumberger Technology Corporation, Sugar Land, TX (US)

(72) Inventors: Dale Meek, Sugar Land, TX (US); Erik Quam, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1029 days.

(21) Appl. No.: 14/338,263

(22) Filed: Jul. 22, 2014

(65) Prior Publication Data

US 2014/0332202 A1 Nov. 13, 2014

Related U.S. Application Data

(62) Division of application No. 12/651,627, filed on Jan. 4, 2010, now abandoned.

(51) Int. Cl.
*E21B 43/12* (2006.01)
*E21B 33/12* (2006.01)
(Continued)

(52) U.S. Cl.
CPC ..... *E21B 33/12* (2013.01); *E21B 21/00* (2013.01); *E21B 41/00* (2013.01); *E21B 43/128* (2013.01);
(Continued)

(58) Field of Classification Search
CPC ..... E21B 33/12; E21B 21/00; E21B 41/00; E21B 43/126; E21B 43/128–43/129;
(Continued)

(56) References Cited

U.S. PATENT DOCUMENTS 3,756,076 A 9/1973 Quichaud et al.
4,077,748 A * 3/1978 Potz ..... F02C 3/107 290/4 R
(Continued)

FOREIGN PATENT DOCUMENTS

WO 2008024856 A1 2/2008

OTHER PUBLICATIONS

Wikipedia page For Clutch, published Dec. 22, 2008.*
(Continued)

*Primary Examiner* — Charles Freay
*Assistant Examiner* — Thomas Fink

(57) ABSTRACT

A system and a method are disclosed herein that relate to powering a pumping system within a downhole tool. The system may include a turbine having a shaft extending therefrom, in which the turbine is configured to convert energy from a fluid received therein into rotational energy for the shaft. The system may further include a pumping system coupled to the shaft of the turbine, in which the pumping system includes one or more driving devices coupled to one or more displacement units. The displacement units may have a cavity formed therein, in which the cavity is configured to receive a fluid therein. The driving devices may then be configured to drive the displacement units such that the fluid is received within the cavity of the displacement units.

17 Claims, 16 Drawing Sheets

(51) Int. Cl.
*F04B 17/00* (2006.01)
*E21B 21/00* (2006.01)
*E21B 41/00* (2006.01)

(52) U.S. Cl.
CPC ..... *E21B 43/129* (2013.01); *F04B 17/00* (2013.01); *E21B 41/0085* (2013.01); *Y10T 29/49236* (2015.01)

(58) Field of Classification Search
CPC ..... E21B 41/0085; F04B 17/00; F04B 9/10; Y10T 29/49236; F04D 13/10; F04D 25/0673; F04D 25/0686; F04D 25/00; F04D 25/06
USPC ..... 417/374
See application file for complete search history.

(56) References Cited

U.S. PATENT DOCUMENTS 4,285,401 A 8/1981 Erickson
4,628,495 A 12/1986 Peppers et al.
4,869,100 A 9/1989 Birdwell
5,799,733 A 9/1998 Ringgenberg et al.
5,860,795 A 1/1999 Ridley et al.
6,019,182 A 2/2000 Rountree et al.
6,092,416 A 7/2000 Halford et al.
6,641,434 B2 11/2003 Boyle et al.
6,860,726 B2 * 3/2005 Carter, III ..... B64D 41/00 417/319
6,986,282 B2 1/2006 Ciglenec et al.
7,114,562 B2 10/2006 Fisseler et al.
7,191,831 B2 3/2007 Reid et al.
7,863,767 B2 1/2011 Chapple et al.
7,934,547 B2 5/2011 Milkovisch et al.
8,042,611 B2 10/2011 Briquet et al.
8,720,539 B2 5/2014 Patterson, II et al.
2004/0025507 A1 * 2/2004 Leigh ..... B64D 37/32 60/608
2004/0088982 A1 * 5/2004 Brasz ..... F01D 15/10 60/651
2006/0191681 A1 * 8/2006 Storm ..... E21B 41/0085 166/250.01
2007/0044959 A1 3/2007 Georgi
2008/0053663 A1 3/2008 Moore
2008/0156486 A1 * 7/2008 Ciglenec ..... E21B 49/10 166/250.15
2009/0025926 A1 1/2009 Briquet et al.
2009/0044951 A1 2/2009 Milkovisch et al.
2011/0164999 A1 7/2011 Meek
2015/0226208 A1 * 8/2015 Shaw ..... E21B 43/129 417/377
2016/0131229 A1 * 5/2016 Hehenberger ..... F04D 25/028 475/80
2017/0335756 A1 * 11/2017 Donkin ..... F02B 37/10
2018/0166946 A1 * 6/2018 Walsh ..... H02K 7/09

OTHER PUBLICATIONS

Development of a High Pressure/High Temperature Downhole Turbine Generator, by Price, published 2007.*
Extended European Search Report issued in related EP application EP10196909.5 dated Apr. 28, 2015, 7 pages.
Examination Report 94(3) EPC issued in EP application EP10196909.5 on Oct. 16, 2017, 3 pages.

* cited by examiner

POWER PUMPING SYSTEM AND METHOD FOR A DOWNHOLE TOOL

CROSS-REFERENCE TO RELATED APPLICATIONS

This application is a divisional of U.S. patent application Ser. No. 12/651,627, entitled "Power Pumping System and Method for a Downhole Tool," filed Jan. 4, 2010, the entire disclosure of which is hereby incorporated herein by reference.

BACKGROUND OF THE DISCLOSURE

Wells are generally drilled into the ground or ocean bed to recover natural deposits of oil and gas, as well as other desirable materials that are trapped in geological formations in the Earth's crust. As wells are typically drilled using a drill bit attached to the lower end of a "drill string." Drilling fluid, or mud, is typically pumped down through the drill string to the drill bit. The drilling fluid lubricates and cools the bit, and may additionally carry drill cuttings from the borehole back to the surface.

In various oil and gas exploration operations, it may be beneficial to have information about the subsurface formations that are penetrated by a borehole. For example, certain formation evaluation schemes include measurement and analysis of the formation pressure and permeability. These measurements may be essential to predicting the production capacity and production lifetime of the subsurface formation.

Reservoir well production and testing may involve drilling into the subsurface formation and the monitoring of various subsurface formation parameters. When drilling and monitoring, downhole tools having electric, mechanic, and/or hydraulic powered devices may be used. To energize downhole tools using hydraulic power, various systems may be used to pump fluid, such as hydraulic fluid. Such pump systems may be controlled to vary output pressures and/or flow rates to meet the needs of particular applications. Further, in some implementations, pump systems may be used to draw and pump formation fluid from subsurface formations. A downhole string (e.g., a drill string, coiled tubing, slickline, wireline, etc.) may include one or more pump systems depending on the operations to be performed using the downhole string. However, traditional pump systems may be limited in operation by the range of flow rates that may be achieved.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
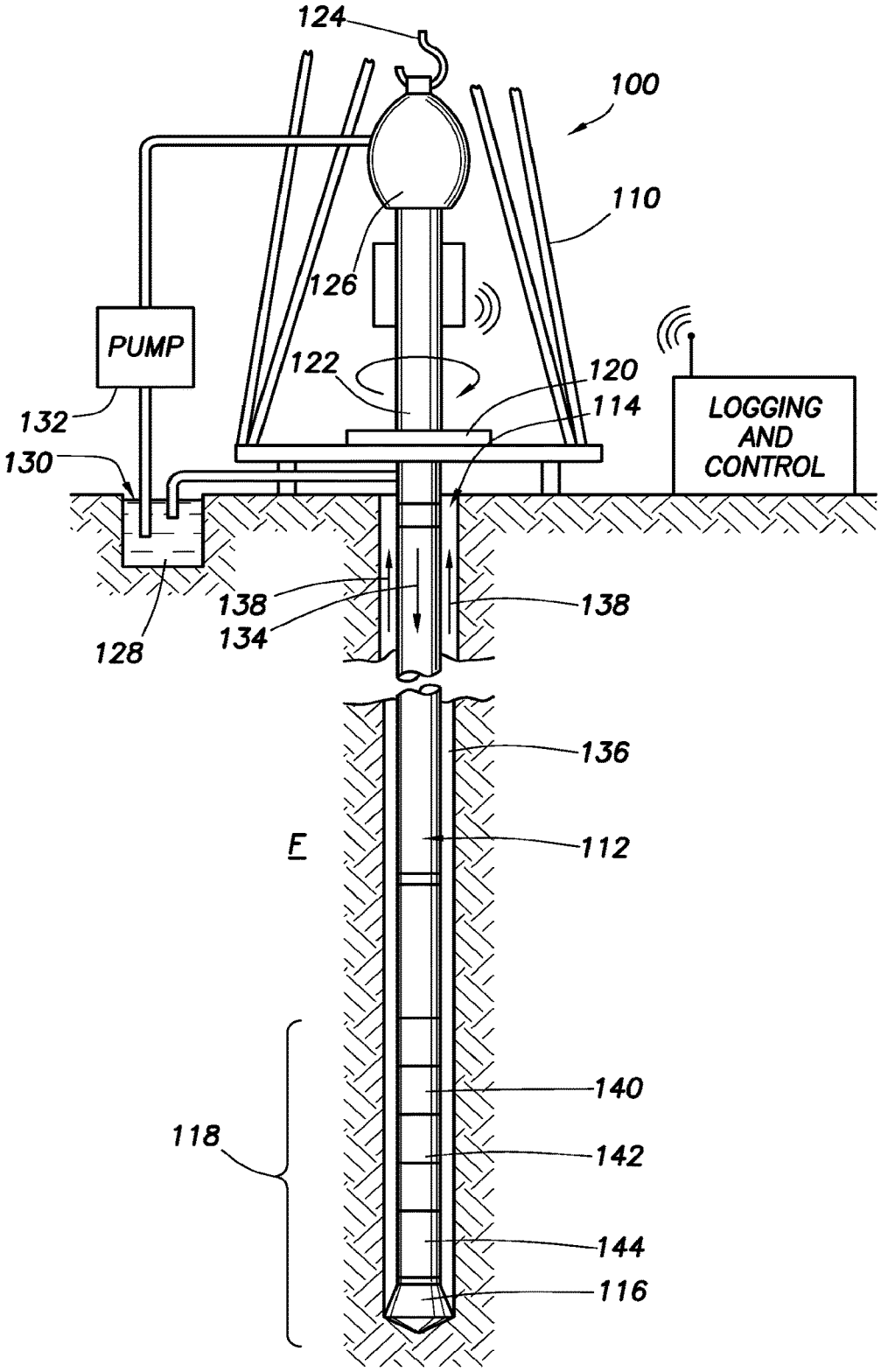
FIG. 1 shows a side view of a wellsite having a drilling rig with a drill string suspended therefrom in accordance with one or more embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring now to FIG. 1, a side view of a wellsite 100 having a drilling rig 110 with a drill string 112 suspended therefrom in accordance with one or more embodiments of the present disclosure is shown. The wellsite 100 shown, or one similar thereto, may be used within onshore and/or offshore locations. In this embodiment, a borehole 114 may be formed within a subsurface formation F, such as by using rotary drilling, or any other method known in the art. As such, one or more embodiments in accordance with the present disclosure may be used within a wellsite, similar to the one as shown in FIG. 1 (discussed more below). Further, those having ordinary skill in the art will appreciate that the present disclosure may be used within other wellsites or drilling operations, such as within a directional drilling application, without departing from the scope of the present disclosure.

Continuing with FIG. 1, the drill string 112 may suspend from the drilling rig 110 into the borehole 114. The drill string 112 may include a bottom hole assembly 118 and a drill bit 116, in which the drill bit 116 may be disposed at an end of the drill string 112. The surface of the wellsite 100 may have the drilling rig 110 positioned over the borehole 114, and the drilling rig 110 may include a rotary table 120, a kelly 122, a traveling block or hook 124, and may additionally include a rotary swivel 126. The rotary swivel 126 may be suspended from the drilling rig 110 through the hook 124, and the kelly 122 may be connected to the rotary swivel 126 such that the kelly 122 may rotate with respect to the rotary swivel.

Further, an upper end of the drill string 112 may be connected to the kelly 122, such as by threadingly connecting the drill string 112 to the kelly 122, and the rotary table 120 may rotate the kelly 122, thereby rotating the drill string 112 connected thereto. As such, the drill string 112 may be able to rotate with respect to the hook 124. Those having ordinary skill in the art, however, will appreciate that though a rotary drilling system is shown in FIG. 1, other drilling systems may be used without departing from the scope of the present disclosure. For example, a top-drive (also known as a "power swivel") system may be used in accordance with one or more embodiments without departing from the scope of the present disclosure. In such a top-drive system, the hook 124, swivel 126, and kelly 122 are replaced by a drive motor (electric or hydraulic) that may apply rotary torque and axial load directly to drill string 112.

The wellsite 100 may further include drilling fluid 128 (also known as drilling "mud") stored in a pit 130. The pit 130 may be formed adjacent to the wellsite 100, as shown, in which a pump 132 may be used to pump the drilling fluid 128 into the wellbore 114. In this embodiment, the pump 132 may pump and deliver the drilling fluid 128 into and through a port of the rotary swivel 126, thereby enabling the drilling fluid 128 to flow into and downwardly through the drill string 112, the flow of the drilling fluid 128 indicated generally by direction arrow 134. This drilling fluid 128 may then exit the drill string 112 through one or more ports disposed within and/or fluidly connected to the drill string 112. For example, in this embodiment, the drilling fluid 128 may exit the drill string 112 through one or more ports formed within the drill bit 116.

As such, the drilling fluid 128 may flow back upwardly through the borehole 114, such as through an annulus 136 formed between the exterior of the drill string 112 and the interior of the borehole 114, the flow of the drilling fluid 128 indicated generally by direction arrow 138. With the drilling fluid 128 following the flow pattern of direction arrows 134 and 138, the drilling fluid 128 may be able to lubricate the drill string 112 and the drill bit 116, and/or may be able to carry formation cuttings formed by the drill bit 116 (or formed by any other drilling components disposed within the borehole 114) back to the surface of the wellsite 100. As such, this drilling fluid 128 may be filtered and cleaned and/or returned back to the pit 130 for recirculation within the borehole 114.

Though not shown in this embodiment, the drill string 112 may further include one or more stabilizing collars. A stabilizing collar may be disposed within and/or connected to the drill string 112, in which the stabilizing collar may be used to engage and apply a force against the wall of the borehole 114. This may enable the stabilizing collar to prevent the drill string 112 from deviating from the desired direction for the borehole 114. For example, during drilling, the drill string 112 may "wobble" within the borehole 114, thereby enabling the drill string 112 to deviate from the desired direction of the borehole 114. This wobble may also be detrimental to the drill string 112, components disposed therein, and the drill bit 116 connected thereto. However, a stabilizing collar may be used to minimize, if not overcome altogether, the wobble action of the drill string 112, thereby possibly increasing the efficiency of the drilling performed at the wellsite 100 and/or increasing the overall life of the components at the wellsite 100.

As discussed above, the drill string 112 may include a bottom hole assembly 118, such as by having the bottom hole assembly 118 disposed adjacent to the drill bit 116 within the drill string 112. The bottom hole assembly 118 may include one or more components included therein, such as components to measure, process, and store information. Further, the bottom hole assembly 118 may include components to communicate and relay information to the surface of the wellsite.

As such, in this embodiment shown in FIG. 1, the bottom hole assembly 118 may include one or more logging-while-drilling ("LWD") tools 140 and/or one or more measuring-while-drilling ("MWD") tools 142. Further, the bottom hole assembly 118 may also include a steering-while-drilling system (e.g., a rotary-steerable system) and motor 144, in which the rotary-steerable system and motor 144 may be coupled to the drill bit 116.

The LWD tool 140 shown in FIG. 1 may include a thick-walled housing, commonly referred to as a drill collar, and may include one or more of a number of logging tools known in the art. Thus, the LWD tool 140 may be capable of measuring, processing, and/or storing information therein, as well as capabilities for communicating with equipment disposed at the surface of the wellsite 100.

Further, the MWD tool 142 may also include a housing (e.g., drill collar), and may include one or more of a number of measuring tools known in the art, such as tools used to measure characteristics of the drill string 112 and/or the drill bit 116. The MWD tool 142 may also include an apparatus for generating and distributing power within the bottom hole assembly 118. For example, a mud turbine generator powered by flowing drilling fluid therethrough may be disposed within the MWD tool 142. Alternatively, other power generating sources and/or power storing sources (e.g., a battery) may be disposed within the MWD tool 142 to provide power within the bottom hole assembly 118. As such, the MWD tool 142 may include one or more of the following measuring tools: a weight-on-bit measuring device, a torque measuring device, a vibration measuring device, a shock measuring device, a stick slip measuring device, a direction measuring device, an inclination measuring device, and/or any other device known in the art used within an MWD tool.

Figure 2:
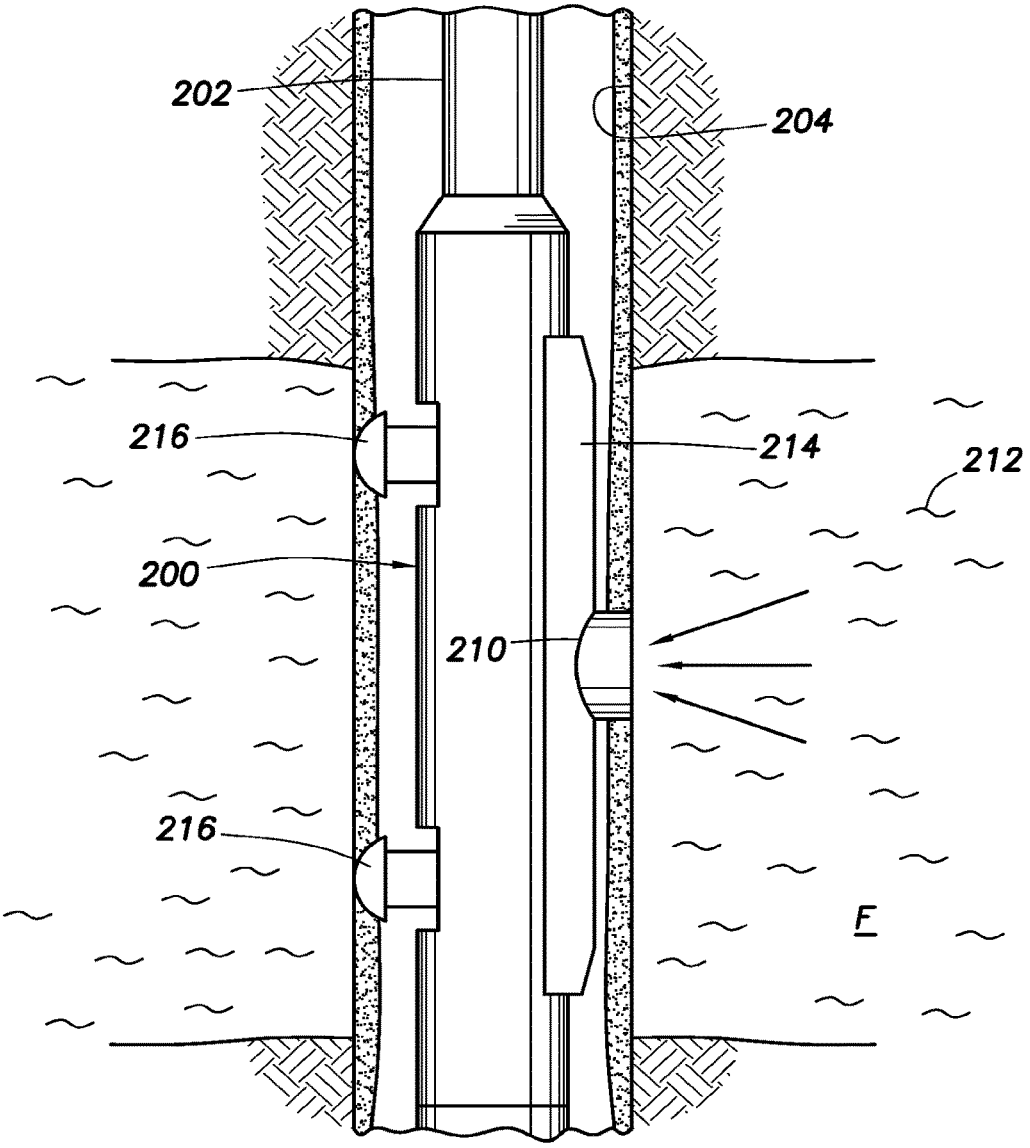
FIG. 2 shows a side view of a tool in accordance with one or more embodiments of the present disclosure.

Referring now to FIG. 2, a side view of a tool 200 in accordance with one or more embodiments of the present disclosure is shown. The tool 200 may be connected to and/or included within a drill string 202, in which the tool 200 may be disposed within a borehole 204 formed within a subsurface formation F. As such, the tool 200 may be included and used within a bottom hole assembly, as described above.

Particularly, in this embodiment, the tool 200 may include a sampling-while drilling ("SWD") tool, such as that described within U.S. Pat. No. 7,114,562, filed on Nov. 24, 2003, entitled "Apparatus and Method for Acquiring Information While Drilling," and incorporated herein by reference in its entirety. As such, the tool 200 may include a probe 210 to hydraulically establish communication with the formation F and draw formation fluid 212 into the tool 200.

In this embodiment, the tool 200 may also include a stabilizer blade 214 and/or one or more pistons 216. As such, the probe 210 may be disposed on the stabilizer blade 214 and extend therefrom to engage the wall of the borehole 204. The pistons, if present, may also extend from the tool 200 to assist probe 210 in engaging with the wall of the borehole 204. In alternative embodiments, though, the probe 210 may not necessarily engage the wall of the borehole 204 when drawing formation fluid 212 from the formation F.

As such, fluid 212 drawn into the tool 200 may be measured to determine one or more parameters of the formation F, such as pressure and/or pretest parameters of the formation F. Additionally, the tool 200 may include one or more devices, such as sample chambers or sample bottles, that may be used to collect formation fluid samples. These formation fluid samples may be retrieved back at the surface with the tool 200. Alternatively, rather than collecting formation fluid samples, the formation fluid 212 received within the tool 200 may be circulated back out into the formation F and/or borehole 204. As such, a pumping system may be included within the tool 200 to pump the formation fluid 212 circulating within the tool 200. For example, the pumping system may be used to pump formation fluid 212 from the probe 210 to the sample bottles and/or back into the formation F.

Figure 3:
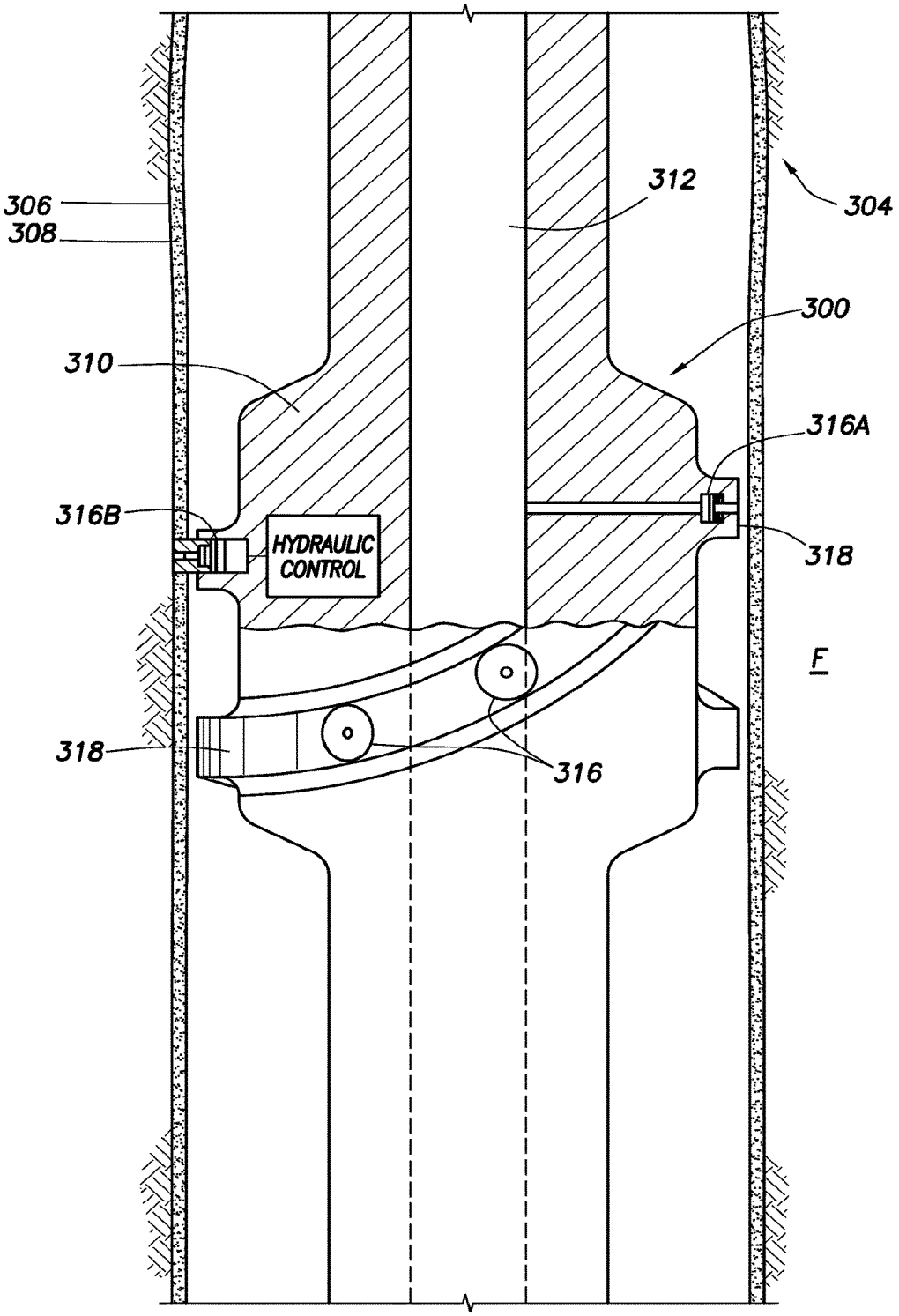
FIG. 3 shows a schematic view of a tool in accordance with one or more embodiments of the present disclosure.

Referring now to FIG. 3, a schematic view of a tool 300 in accordance with one or more embodiments of the present disclosure is shown. The tool 300 may be connected to and/or included within a bottom hole assembly, in which the tool 300 may be disposed within a borehole 304 formed within a subsurface formation F.

In this embodiment, the tool 300 may be a pressure LWD tool used to measure one or more downhole pressures, including annular pressure, formation pressure, and pore pressure, before, during, and/or after a drilling operation. Further, those having ordinary skill in the art will appreciate that other pressure LWD tools may also be utilized in one or more embodiments, such as that described within U.S. Pat. No. 6,986,282, filed on Feb. 18, 2003, entitled "Method and Apparatus for Determining Downhole Pressures During a Drilling Operation," and incorporated herein by reference.

As shown, the tool 300 may be formed as a modified stabilizer collar 310, similar to a stabilizer collar as described above, and may have a passage 312 formed therethrough for drilling fluid. The flow of the drilling fluid through the tool 300 may create an internal pressure P1, and the exterior of the tool 300 may be exposed to an annular pressure PA of the surrounding borehole 304 and formation F. A differential pressure Pδ formed between the internal pressure P1 and the annular pressure PA may then be used to activate one or more pressure devices 316 included within the tool 300.

In this particular embodiment, the tool 300 includes two pressure measuring devices 316A and 316B that may be disposed on stabilizer blades 318 formed on the stabilizer collar 310. The pressure measuring device 316A may be used to measure the annular pressure PA in the borehole 304, and/or may be used to measure the pressure of the formation F when positioned in engagement with a wall 306 of the borehole 304. As shown in FIG. 3, the pressure measuring device 316A is not in engagement with the borehole wall 306, thereby enabling the pressure measuring device 316A to measure the annular pressure PA, if desired. However, when the pressure measuring device 316A is moved into engagement with the borehole wall 306, the pressure measuring device 316A may be used to measure pore pressure of the formation F.

As also shown in FIG. 3, the pressure measuring device 316B may be extendable from the stabilizer blade 318, such as by using a hydraulic control disposed within the tool 300. When extended from the stabilizer blade 318, the pressure measuring device 316B may establish sealing engagement with the wall 306 of the borehole 304 and/or a mudcake 308 of the borehole 304. This may enable the pressure measuring device 316B to take measurements of the formation F also. Other controllers and circuitry, not shown, may be used to couple the pressure measuring devices 316 and/or other components of the tool 300 to a processor and/or a controller. This processor and/or controller may then be used to communicate the measurements from the tool 300 to other tools within a bottom hole assembly or to the surface of a wellsite. As such, a pumping system in accordance with embodiments disclosed herein may be included within the tool 300, such as including the pumping system within one or more of the pressure devices 316 for activation and/or movement of the pressure devices 316.

Figure 4:
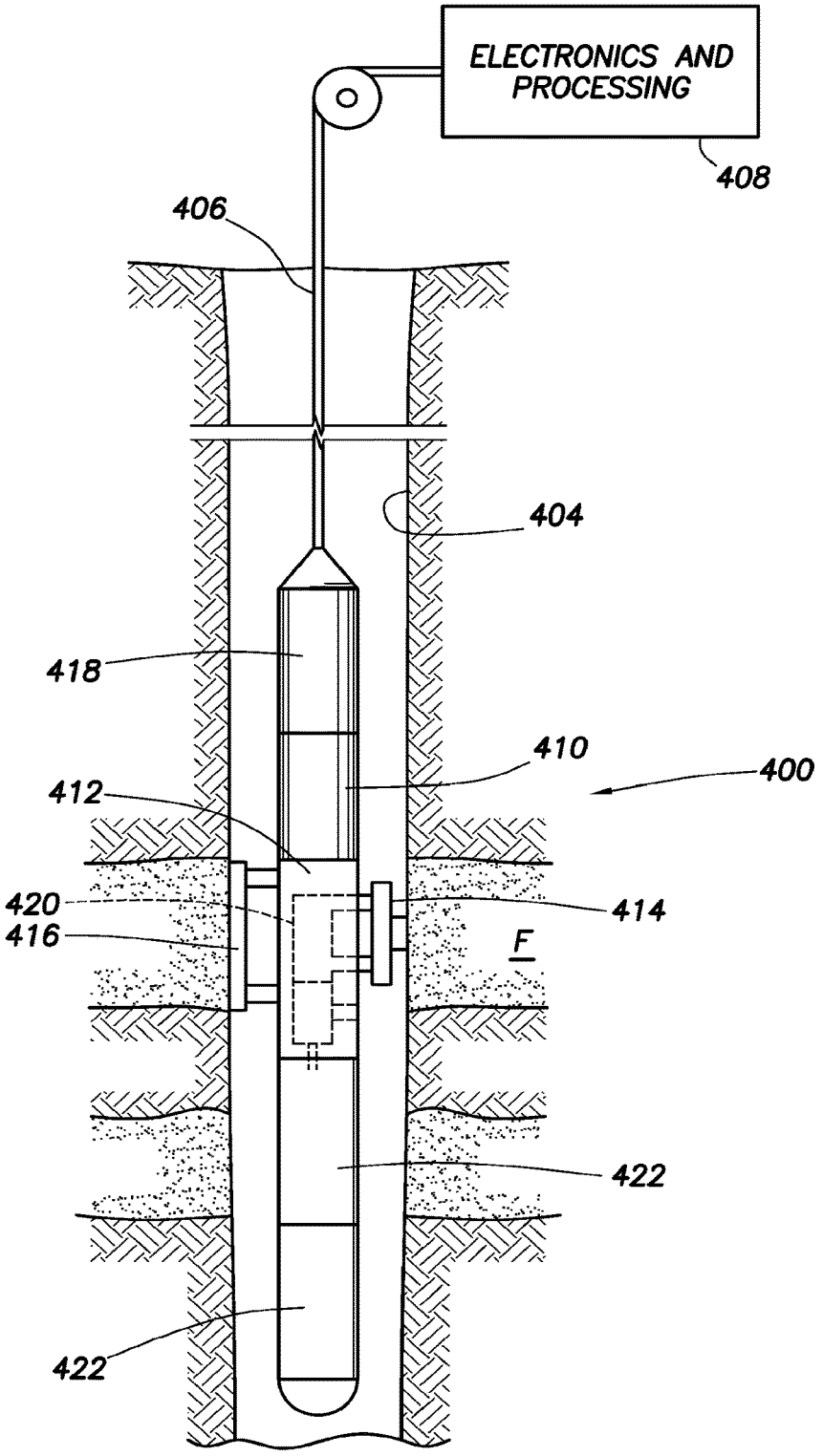
FIG. 4 shows a side view of a tool in accordance with one or more embodiments of the present disclosure.

Referring now to FIG. 4, a side view of a tool 400 in accordance with one or more embodiments of the present disclosure is shown. In this embodiment, the tool 400 may be a "wireline" tool, in which the tool 400 may be suspended within a borehole 404 formed within a subsurface formation F. As such, the tool 400 may be suspended from an end of a multi-conductor cable 406 located at the surface of the formation F, such as by having the multi-conductor cable 406 spooled around a winch (not shown) disposed on the surface of the formation F. The multi-conductor cable 406 is then couples the tool 400 with an electronics and processing system 408 disposed on the surface.

The tool 400 shown in this embodiment may have an elongated body 410 that includes a formation tester 412 disposed therein. The formation tester 412 may include an extendable probe 414 and an extendable anchoring member 416, in which the probe 414 and anchoring member 416 may be disposed on opposite sides of the body 410. One or more other components 418, such as a measuring device, may also be included within the tool 400.

The probe 414 may be included within the tool 400 such that the probe 414 may be able to extend from the body 410 and then selectively seal off and/or isolate selected portions of the wall of the borehole 404. This may enable the probe 414 to establish pressure and/or fluid communication with the formation F to draw fluid samples from the formation F. The tool 400 may also include a fluid analysis tester 420 that is in fluid communication with the probe 414, thereby enabling the fluid analysis tester 420 to measure one or more properties of the fluid. The fluid from the probe 414 may also be sent to one or more sample chambers or bottles 422, which may receive and retain fluids obtained from the formation F for subsequent testing after being received at the surface. The fluid from the probe 414 may also be sent back out into the borehole 404 or formation F. As such, a pumping system may be included within the tool 400 to pump the formation fluid circulating within the tool 400. For example, the pumping system may be used to pump formation fluid from the probe 414 to the sample bottles 422 and/or back into the formation F.

Figure 5:
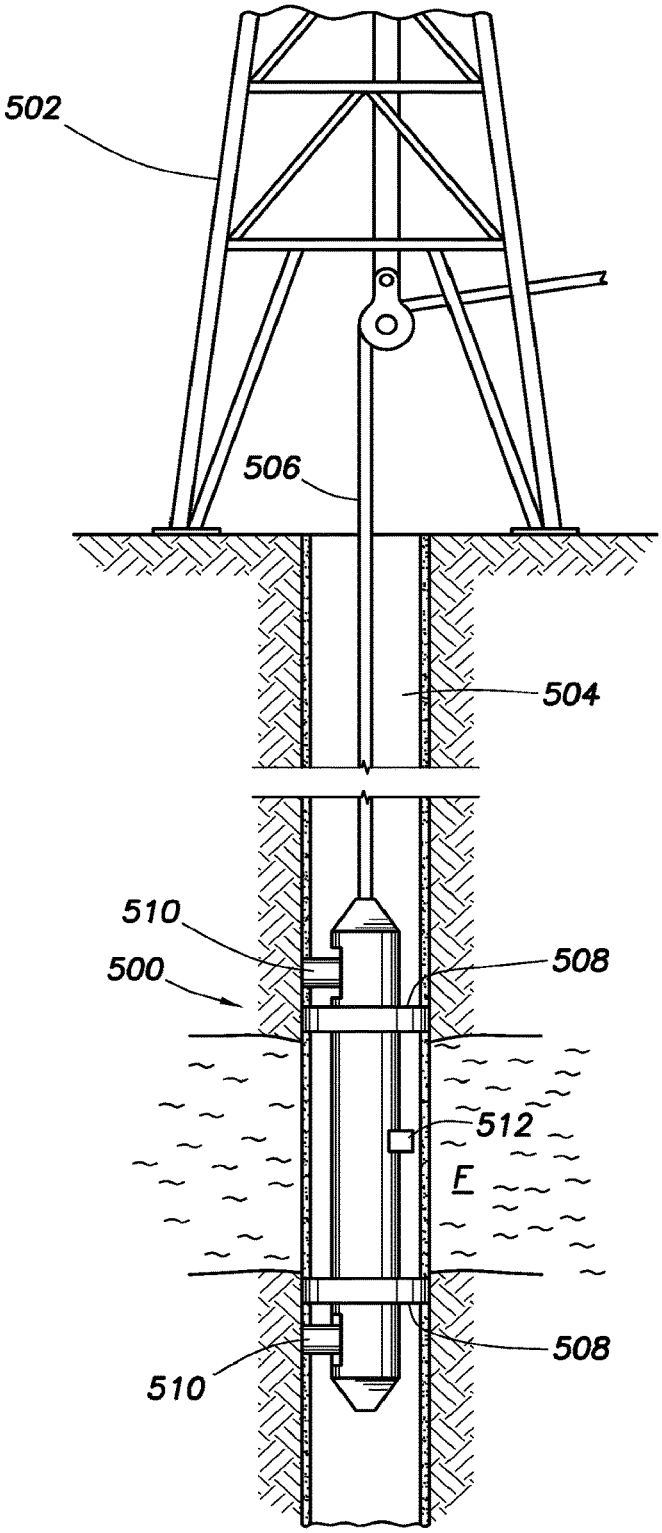
FIG. 5 shows a side view of a tool in accordance with one or more embodiments of the present disclosure.

Referring now to FIG. 5, a side view of another tool 500 in accordance with one or more embodiments of the present disclosure is shown. Similar to the above embodiment in FIG. 4, the tool 500 may be suspended within a borehole 504 formed within a subsurface formation F using a multi-conductor cable 506. In this embodiment, the multi-conductor cable 506 may be supported by a drilling rig 502.

As shown in this embodiment, the tool 500 may include one or more packers 508 that may be configured to inflate, thereby selectively sealing off a portion of the borehole 504 for the tool 500. Further, to test the formation F, the tool 500 may include one or more probes 510, and the tool 500 may also include one or more outlets 512 that may be used to inject fluids within the sealed portion established by the packers 508 between the tool 500 and the formation F. As such, similar to the above embodiments, a pumping system may be included within the tool 500 to pump fluid circulating within the tool 500. For example, the pumping system may be used to selectively inflate and/or deflate the packers 508, in addition to pumping fluid out of the outlet 512 into the sealed portion formed by the packers 508.

Figure 6:
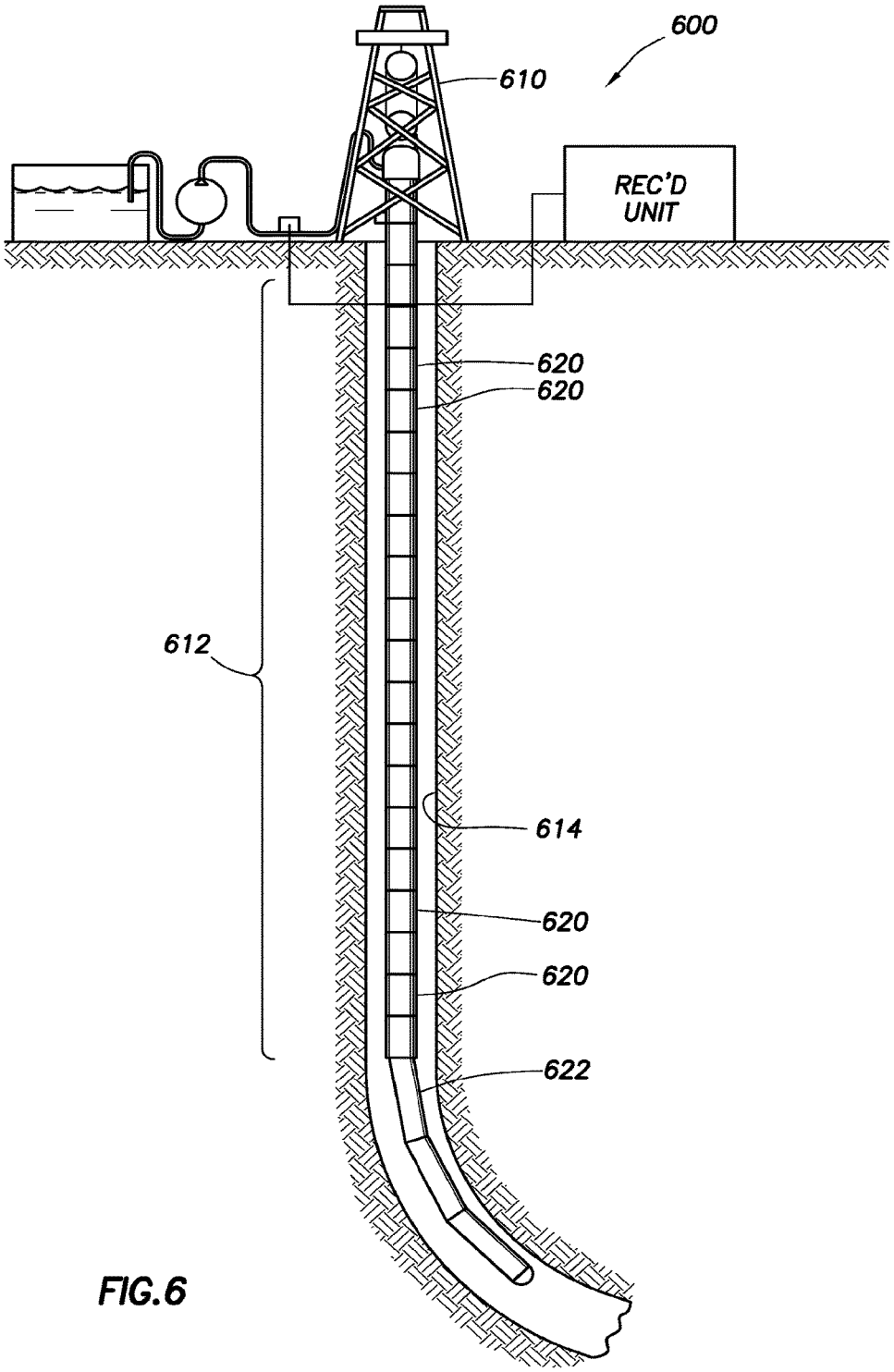
FIG. 6 shows a side view of a wellsite having a drilling rig in accordance with one or more embodiments of the present disclosure.

Referring now to FIG. 6, a side view of a wellsite 600 having a drilling rig 610 in accordance with one or more embodiments of the present disclosure is shown. In this embodiment, a borehole 614 may be formed within a subsurface formation F, such as by using a drilling assembly, or any other method known in the art. Further, in this embodiment, a wired pipe string 612 may be suspended from the drilling rig 610. The wired pipe string 612 may be extended into the borehole 614 by threadably coupling multiple segments 620 (i.e., joints) of wired drill pipe together in an end-to-end fashion. As such, the wired drill pipe segments 620 may be similar to that as described within U.S. Pat. No. 6,641,434, filed on May 31, 2002, entitled "Wired Pipe Joint with Current-Loop Inductive Couplers," and incorporated herein by reference.

Wired drill pipe may be structurally similar to that of typical drill pipe, however the wired drill pipe may additionally include a cable installed therein to enable communication through the wired drill pipe. The cable installed within the wired drill pipe may be any type of cable capable of transmitting data and/or signals therethrough, such an electrically conductive wire, a coaxial cable, an optical fiber cable, and or any other cable known in the art. Further, the wired drill pipe may include having a form of signal coupling, such as having inductive coupling, to communicate data and/or signals between adjacent pipe segments assembled together.

As such, the wired pipe string 612 may include one or more tools 622 and/or instruments disposed within the pipe string 612. For example, as shown in FIG. 6, a string of multiple borehole tools 622 may be coupled to a lower end of the wired pipe string 612. The tools 622 may include one or more tools used within wireline applications, may include one or more LWD tools, may include one or more formation evaluation or sampling tools, and/or may include any other tools capable of measuring a characteristic of the formation F.

The tools 622 may be connected to the wired pipe string 612 during drilling the borehole 614, or, if desired, the tools 622 may be installed after drilling the borehole 614. If installed after drilling the borehole 614, the wired pipe string 612 may be brought to the surface to install the tools 622, or, alternatively, the tools 622 may be connected or positioned within the wired pipe string 612 using other methods, such as by pumping or otherwise moving the tools 622 down the wired pipe string 612 while still within the borehole 614. The tools 622 may then be positioned within the borehole 614, as desired, through the selective movement of the wired pipe string 612, in which the tools 622 may gather measurements and data. These measurements and data from the tools 622 may then be transmitted to the surface of the borehole 614 using the cable within the wired drill pipe 612. As such, a pumping system in accordance with embodiments disclosed herein may be included within the wired drill pipe 612, such as by including the pumping system within one or more of the tools 622 of the wired drill pipe 612 for activation and/or measurement purposes.

As discussed above, a pumping system, and a system to power a pumping system, in accordance with the present disclosure may be included within one or more of the embodiments shown in FIGS. 1-6, in addition to being included within other tools and/or devices that may be disposed downhole within a formation. The pumping system and a system to provide power thereto, thus, may be used within a tool to provide a relatively larger range of flow rates, as compared to one or more traditional pumping systems. For example, as shown above with respect to FIGS. 1-6, a pumping system may be used within a number of embodiments. As such, a pumping system having a relatively lower flow rate may be desired for one embodiment, whereas a pumping system having a relatively higher flow rate may be desired for another embodiment. However, one or more of the traditional pumping systems may be able to provide only one of these higher or lower flow rates, thereby not enabling the traditional pumping system to be used within both the higher and lower flow rate embodiments.

Thus, in accordance with the present disclosure, embodiments disclosed herein generally relate to a pumping system and a system to provide power thereto that may be used within a downhole tool, such as a tool provided within one or more of the embodiments shown in FIGS. 1-6, in addition to being included within other tools and/or devices that may be disposed downhole.

A system in accordance with one or more embodiments of the present disclosure may include a turbine having a shaft extending therefrom, in which the turbine is configured to convert energy from a fluid received therein into rotational energy for the shaft, such as having the fluid pumped downhole to have the turbine receive the pumped fluid and convert energy from the pumped fluid into rotational energy for the shaft. The system may further include a pumping system coupled to the shaft of the turbine, in which the pumping system includes one or more displacement units, a first driving device, and a second driving device. The displacement unit may have a cavity formed therein, in which the cavity is configured to receive a second fluid therein. The first driving device may be coupled to the shaft of the turbine and may be configured to drive the displacement unit such that the second fluid is received within the cavity of the displacement unit. Further, the second driving device may be coupled to a motor and may be configured to drive the displacement unit such that the second fluid is received within the cavity. Furthermore, the motor may be configured to convert electrical energy from an electrical energy source into energy to be used by the second driving device.

In one embodiment, in which the pumping system includes more than one displacement unit, particularly two displacement units, the first driving device may be configured to drive the first displacement unit such that the second fluid is received within the cavity of the first displacement unit. Further, the second driving device may then be configured to drive the second displacement unit such that the second fluid is received within the cavity of the first displacement unit.

The first driving device and/or the second driving device may be either a hydraulic driving device or a mechanical driving device. A hydraulic driving device, in accordance with one or more embodiments of the present disclosure, may include a hydraulic pump, in which the hydraulic pump may be used to pump fluid into one of the cavities of the displacement unit. A mechanical driving device in accordance with one or more embodiments of the present disclosure may include a roller screw, in which the roller screw may be used to couple with one of the pistons of the displacement unit. Further, the driving device may include other driving devices known in the art, such as a progressive cavity pump, without departing from the scope of the present disclosure.

Additionally or alternatively, a system in accordance with one or more embodiments of the present disclosure may include a turbine, a displacement unit, an energy accumulator, and a driving device. The turbine may have a shaft extending therefrom, in which the turbine is configured to convert energy from a fluid received therein into rotational energy for the shaft. The displacement unit may have a cavity formed therein, in which the cavity is configured to receive a second fluid therein. The energy accumulator may be configured to receive, at least a portion of, rotational energy from the shaft of the turbine and store energy therein. Further, the driving device may be configured to couple to the shaft of the turbine and may also be configured to drive the displacement unit such that the second fluid is received within the cavity using at least one of rotational energy received from the shaft of the turbine and energy stored within the energy accumulator.

The system may further include a motor coupled to the shaft of the turbine and having a second shaft extending therefrom, and may include an alternator coupled to the motor such that the alternator may be configured to convert rotational energy from the shaft of the turbine into electrical energy. The energy accumulator may then be electrically coupled to the alternator and may be configured to receive rotational energy from the shaft of the turbine by receiving electrical energy from the alternator and storing electrical energy therein. Further, in accordance with one or more embodiments of the present disclosure, the energy accumulator may be an electrical energy accumulator and/or a hydraulic energy accumulator.

Figure 7:
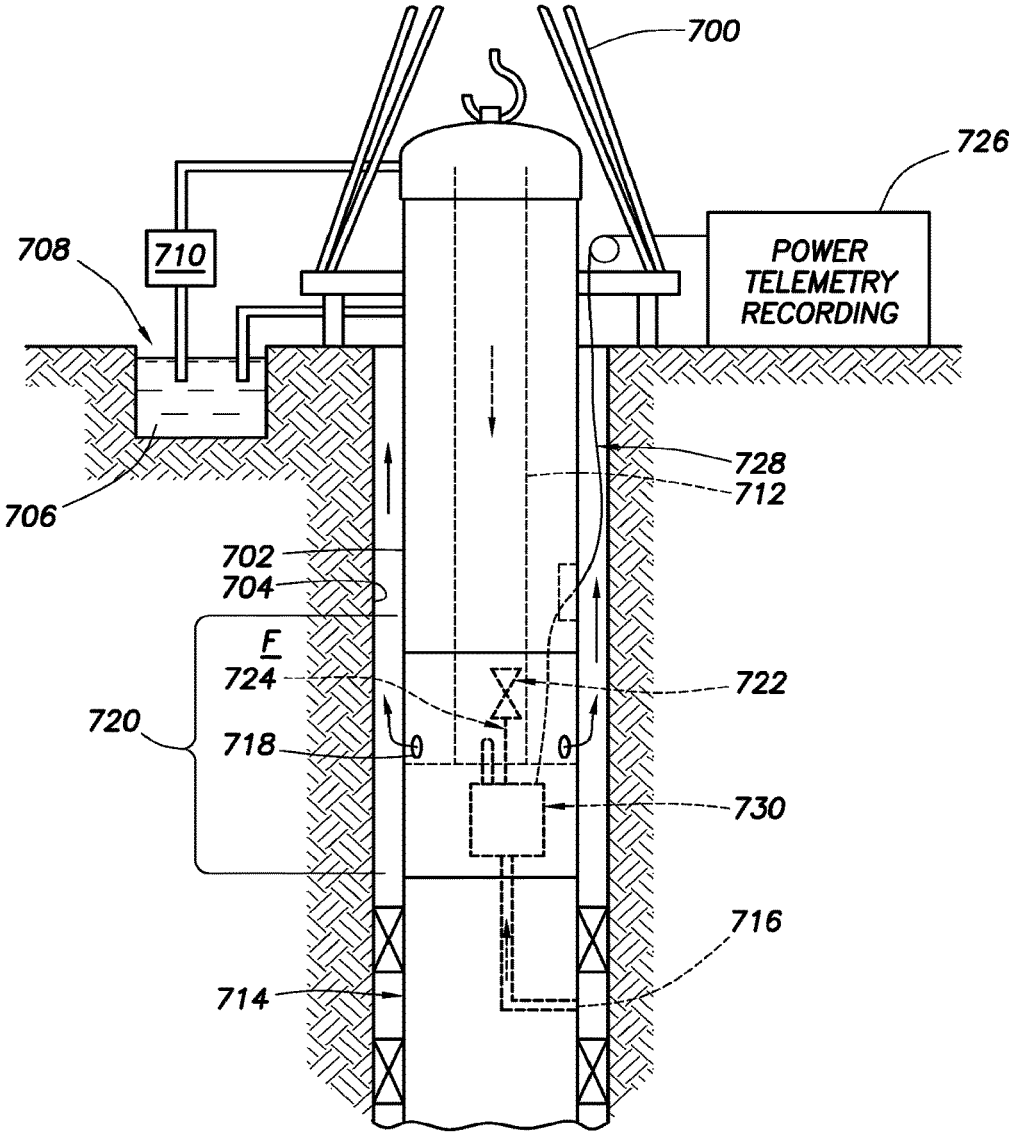
FIG. 7 shows a side view of a system in accordance with one or more embodiments of the present disclosure.

Referring now to FIG. 7, a side view of a system 720 in accordance with one or more embodiments of the present disclosure is shown. Similar to one or more of the above embodiments, FIG. 7 depicts a drilling rig 700 with a drill string 702 suspended therefrom and disposed within a borehole 704. Drilling fluid 706 may also be provided, such as by having the drilling fluid 706 stored in a pit 708 formed adjacent to the drilling rig 700. A pump 710 may then be used to pump the drilling fluid 706 into the borehole 704, such as by pumping the drilling fluid 706 into an inner bore 712 formed in the drill string 702, in which the drill string 702 is disposed within the borehole 704.

Further, as shown, a tool 714 may be included within the drill string 702, such as by having the tool 714 coupled to the drill string 702. In this embodiment, the tool 714 may be a SWD tool, in which the tool 714 may include one or more packers that may be configured to inflate, thereby selectively sealing off a portion of the borehole 704. The tool 714 may further include one or more inlets 716, such as a probe, in which the tool 714 may be used to test fluids from a formation F received within the inlet 716. Those having ordinary skill in the art, though, will appreciate that any downhole tool, in addition or in alternative to the tool 714 shown in FIG. 7, may be used in accordance with one or more embodiments of the present disclosure.

As shown, the drilling fluid 706 may be pumped from the pit 708 disposed at the surface of the wellsite and may be circulated through the inner bore 712 of the drill string 702. The drilling fluid 706 may then exit the drill string 702, such as by exiting the drill string 702 using one or more outlets 718 disposed above the tool 714, and/or by exiting the drill string 702 using other outlets (not shown here) disposed below the tool 714, such as by exiting through a drill bit disposed at the end of the drill string 702. The drilling fluid 706 may then return to the surface and be re-circulated into the pit 708, if desired.

With this arrangement, the drilling fluid 706 may be pumped by the pump 710 through a turbine 722 included within the system 720 of the drill string 702. The turbine 722 may be fluidly coupled to the inner bore 712 of the drill string 702, in which the drilling fluid 706 pumped through the turbine 722 may be used to drive the turbine 722. The turbine 722 may use the drilling fluid 706 pumped therethrough to rotate a shaft 724 coupled to the turbine 722 and extending from the turbine 722. The turbine 722 may, thus, be used to convert energy from the drilling fluid 706 pumped therethrough and convert the energy into rotational energy to be used by the shaft 724 coupled to the turbine 722. As such, the turbine 722 may be similar to a mud motor and/or a turbine, similar to that as described within U.S. Patent Publication No. 2008/0156486, filed on Dec. 27, 2006, entitled "Pump Control for Formation Testing," and incorporated herein by reference in its entirety.

Further, continuing with FIG. 7, the system 720 may be coupled to an electrical energy source 726, such as, in this embodiment, the electrical energy source 726 disposed at the surface with the drilling rig 700. Particularly, in this embodiment, the electrical energy source 726 is electrically coupled to the system 720 using a cable 728, such as a multi-conductor cable. As such, the electrical energy source 726 may be used to provide electrical energy to one or more components included within the system 720. In one or more embodiments, though, electrical energy may additionally and/or alternatively be supplied by an electrical energy source disposed within the borehole 704, such as by having a battery included within the drill string 702 and providing electrical energy to the system 720 (discussed more below).

The system 720 may further include a pumping system 730, in which the pumping system 730 may be used within one or more of the embodiments and tools discussed above with respect to FIGS. 1-6. For example, in FIG. 7, as the tool 714 may include an inlet 716 to receive fluid from the formation F, the pumping system 730 may be fluidly coupled to the tool 714 such as to receive the fluid received by the inlet 716.

As such, in accordance within one or more embodiments of the present disclosure, power and energy may be provided to the pumping system 730 using energy from the drilling fluid 706 pumped into the borehole 704, in addition to energy received from the electrical energy source 726. For example, as drilling fluid 706 is pumped into the inner bore 712 of the drill string 702, the pumped drilling fluid 706 may be received by the turbine 722 such that the turbine 722 may convert energy from the pumped drilling fluid 706 into rotational energy for the shaft 724 extending from the turbine 722. The pumping system 730 may be coupled to the shaft 724 of the turbine 722, in which the pumping system 730 may use the rotational energy from the shaft 724 to drive one or more components of the pumping system 730. Further, energy may additionally or alternatively be provided to the pumping system 730 from the electrical energy source 726, such as from an electrical energy source disposed at the surface, or an electrical energy source disposed within the borehole 704.

As the pumping system 730 may be used for one or more applications within the drill string 702, such as to power tools and/or pump fluids within the drill string 702, the pumping system 730 may selectively use energy from the turbine 722 and/or the electrical energy source 726 to power the pumping system 730, as needed. In embodiments in which a larger amount of energy may be needed by the pumping system 730, the pumping system 730 may use the turbine 722 to provide energy to the pumping system 730. In embodiments in which a smaller amount of energy may be needed by the pumping system 730, the pumping system 730 may use the electrical energy source 726 to provide energy to the pumping system 730. Further, in other embodiments, the turbine 722 and the electrical energy source 726 may be used together to provide energy to the pumping system 730. In such embodiments, the turbine 722 may be used to provide energy to one of the components included within the pumping system 730, and the electrical energy source 726 may be used to provide energy to another of the components included within the pumping system 730.

Figure 8:
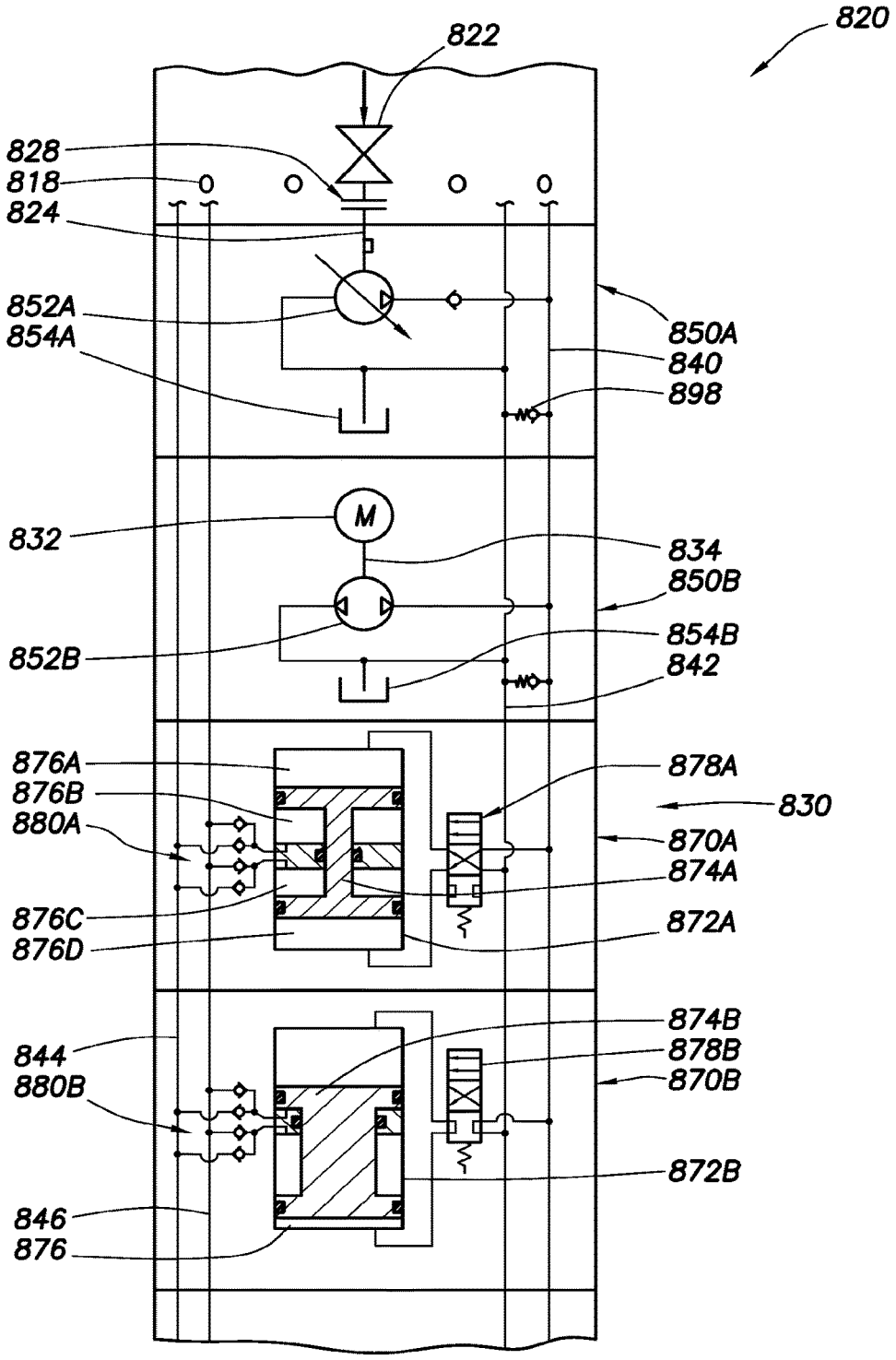
FIG. 8 shows a schematic view of a system having a pumping system included therein in accordance with one or more embodiments of the present disclosure.

Referring now to FIG. 8, a schematic view of a system 820 having a pumping system 830 included therein in accordance with one or more embodiments of the present disclosure is shown. As discussed above, the system 820 may include a turbine 822, in which the turbine 822 may have a shaft 824 coupled thereto and extending therefrom. The turbine 822 may be used to convert energy from fluid pumped therethrough, such as drilling fluid, into rotational energy to be used by the shaft 824 coupled to the turbine 822. Further, one or more outlets 818 may be included, such as by having the outlets 818 disposed below the turbine 822, for an exit through which the fluid received by the turbine 822 may exit through to return to the borehole and be circulated to the surface of the borehole.

As shown in FIG. 8, the pumping system 830 may include one or more driving devices 850 and may include one or more displacement units 870. In this embodiment, the pumping system 830 includes two driving devices 850A and 850B, and further includes two displacement units 870A and 870B. However, those having ordinary skill in the art will appreciate that only one driving device and/or one displacement unit, or more than two driving devices and/or more than two displacement units, may be used in accordance with embodiments disclosed herein.

The driving devices 850A and 850B may be configured to couple to the displacement units 870A and 870B, such as by using the driving devices 850A and 850B to drive the displacement units 870A and 870B. As such, the driving devices 850A and 850B may enable the displacement units 870A and 870B to receive and displace one or more fluids while being driven by the driving devices 850A and 850B.

In the embodiment shown in FIG. 8, because the pumping system 830 includes two driving devices 850A and 850B, one of the driving devices 850A may receive energy for operation from one source, while the other of the driving devices 850B may receive energy for operation from another source. For example, in FIG. 8, the driving device 850A may be coupled to the shaft 824 of the turbine 822, in which rotational energy from the shaft 824 may be used by the driving device 850A for operation to drive one or both of the displacement units 870A and 870B. Further, the driving device 850B may be coupled to another energy source, such as coupled to an electrical energy source, in which the electrical energy may be used by the driving device 850B for operation to drive one or both of the displacement units 870A and 870B.

In this embodiment, the driving devices 850A and 850B are shown as hydraulic driving devices. Particularly, as shown, the driving devices 850A and 850B are shown as hydraulic pumps 852A and 852B, in which the hydraulic pumps 852A and 852B may be used to pump fluid therethrough, such as into one or more of the displacement units 870A and 870B. In the driving device 850A, the hydraulic pump 852A is coupled to the shaft 824 of the turbine 822. The rotational energy of the shaft 824 of the turbine 822 may be used by the hydraulic pump 852A to provide energy to the hydraulic pump 852A. This energy may then be used by the hydraulic pump 852A to receive fluid therein and pump fluid therethrough, such as into one or more of the displacement units 870A and 870B fluidly coupled thereto.

Further, the pumping system 830 may include a motor 832, such as an electric motor, in which the motor 832 is coupled to the driving device 850B. Specifically, in this embodiment, the motor 832 may include a shaft 834 extending therefrom, in which the shaft 834 is coupled to the driving device 850B, such as the hydraulic pump 852A. As discussed above, electrical energy from an electrical energy source may be used by one or more components of the pumping system 830 to pump fluid within and/or through the pumping system 830. As such, in this embodiment, the motor 832 may be electrically coupled to an electrical energy source, in which the electrical energy received by the motor 832 may be converted to rotational energy to rotate the shaft 834 coupled to the motor 832. This rotational energy of the shaft 834 then may be used by the driving device 850B, such as the hydraulic pump 852B, to receive fluid therein and pump fluid therethrough, such as into one or more of the displacement units 870A and 870B fluidly coupled thereto.

As such, the hydraulic pumps 852A and 852B may be fluidly coupled to an outlet flow line 840 and an inlet flow line 842. Fluid pumped by one or both of the hydraulic pumps 852A and 852B may be pumped into the outlet flow line 840, and may then flow onto one or both of the displacement units 870A and 870B also fluidly coupled to the outlet flow line 840. Fluid may then be received by one or both of the hydraulic pumps 852A and 852B from the inlet flow line 840, in which one or both of the displacement units 870A and 870B may also be fluidly coupled to the inlet flow line 842. As such, the flow lines 840 and 842 may be used by the hydraulic pumps 852A and 852B to drive the displacement units 870A and 870B. The hydraulic pumps 852A and 852B may further include one or more hydraulic reservoirs 854A and 854B hydraulically coupled thereto to provide fluid for pumping through the hydraulic pumps 852A and 852B. In one embodiment then, the hydraulic reservoirs 854A and 854B may have the fluid used by the hydraulic pumps 852A and 852B, such as hydraulic fluid, to drive the displacement units 870A and 870B.

Referring still to FIG. 8, the pumping system 830 includes the two displacement units 870A and 870B, in which the displacement units 870A and 870B may also be fluidly coupled to another outlet flow line 846 and another inlet flow line 844. The inlet flow line 844 may be fluidly coupled to a downhole tool, such as a probe or packer from a downhole tool, in which fluid from the downhole tool may be received by one or both of the displacement units 870A and 870B through the inlet flow line 844. Further, the outlet flow line 846 may be fluidly coupled to a downhole tool, such as fluidly coupled to a downhole motor or to one or more sample bottles, or may be fluidly coupled to the borehole, in which fluid may be displaced and pumped by one or more of the displacement units 870A and 870B through the outlet flow line 846.

As shown, the displacement units 870A and 870B include a chamber 872A and 872B having a piston 874A and 874B disposed therein. Depending on the shape and size of the pistons 874A and 874B, the pistons 874A and 874B may define one or more cavities within the displacement units 870A and 870B. For example, with reference to the displacement unit 870A, the piston 874A may define a first cavity 876A, a second cavity 876B, a third cavity 876C, and a fourth cavity 876D, in which the cavities 876A-876D may each receive fluid therein. However, those having ordinary skill in the art will appreciate that a displacement unit in accordance with one or more embodiments of the present disclosure may only need one cavity to receive fluid therein.

As such, because the displacement units 870A and 870B are fluidly coupled to the hydraulic pumps 852A and 852B through the outlet flow line 840 and the inlet flow line 842, fluid pumped by the hydraulic pumps 852A and 852B may be received within the displacement units 870A and 870B to drive the displacement units 870A and 870B. For example, fluid pumped through the outlet flow line 840 may be received into one or both of the displacement units 870A and 870B, such as through valves 878A and 878B. The valves 878A and 878B may be, for example, switch valves, in which the valves 878A and 878B may selectively pump fluid from the outlet flow line 840 into one or more of the cavities 876 of the displacement units 870A and 870B.

As fluid is selectively pumped into the cavities 876 of the displacement units 870A and 870B, fluid pressure from the pumped fluid may cause the pistons 874A and 874B to reciprocate within the chambers 872A and 872B. As such, this reciprocating movement of the pistons 874A and 874B may be used to pump fluid received within the cavities 876 of the displacement units 870A and 870B, such as by enabling the displacement units 870A and 870B to pump fluid received from the inlet flow line 844 into the outlet flow line 846.

For example, in the displacement unit 870A, fluid from the hydraulic pumps 850A and/or 850B may be selectively pumped into the cavities 876A and 876D using the valve 878A to cause the piston 874A to reciprocate. Further, the cavities 876B and 876C may be fluidly coupled to the inlet flow line 844 and the outlet flow line 846 through one or more valves included within a valve block 880A. As such, as the piston 874A reciprocates within the chamber 872A, the piston 874A may be used to selectively receive fluid from the inlet flow line 844 and displace fluid into the outlet flow line 846 through the valve block 880A. This may thereby enable the displacement unit 870A to pump fluid therethrough from the inlet flow line 844 to the outlet flow line 846 by having the hydraulic pumps 852A and 852B drive the displacement unit 870A. Further, fluid received within the displacement unit 870A to pump the displacement unit 870A from the hydraulic pumps 852A and 852B may return to the hydraulic pumps 850A and 850B using the flow line 842, such as for re-circulation of the fluid. Thus, in one example, the flow lines 840 and 842 may be used to pump hydraulic fluid within the displacement units 870A and 870B, and the flow lines 844 and 846 may be used to pump another fluid, such as reservoir or formation fluid, within the displacement units 870A and 870B.

As such, in accordance with one or more embodiments of the present disclosure, the driving devices 850A and 850B may be selectively operated, such as depending on a desired flow rate and/or pressure, to drive the one or more displacement units 870A and 870B fluidly coupled to the driving devices 850A and 850B. For example, the driving devices 850A and 850B may be designed to have different flow rates, as the driving device 850A receives energy from the turbine 822, and the driving device 850B receives energy from the motor 832 coupled to an electrical energy source.

In an embodiment in which a high flow rate may be desired, the driving device 850A may receive energy from the turbine 822 (such as by having drilling fluid pumped into and through the turbine) such that the driving device 850A may pump hydraulic fluid through the pumping system 830. Further, as the flow rate of the driving device 850A may be difficult to regulate, as the flow rate may be dependent on the drilling fluid pumped through the turbine, the driving device 850B may also be operated in conjunction with the driving device 850A, such as by using electrical energy to power the electric motor 832 and operate the driving device 850B. The driving device 850B, thus, may be used to control the overall flow rate output by the driving devices 850A and 850B, thereby enabling the driving devices 850A and 850B to provide a controlled and/or constant flow rate to drive the displacement units 870A and 870B fluidly coupled thereto.

In other embodiments though, such as depending on the desired flow rate, only one of the driving devices 850A and 850B may be used to drive the displacement units 870A and 870B. For example, in an embodiment in which a lower flow rate is desired, only the displacement unit 870B may be used to drive one or more of the displacement units 870A and 870B. Thus, the driving devices 850A and 850B may be selectively controlled to drive the displacement units 870A and 870B.

Figure 9B:
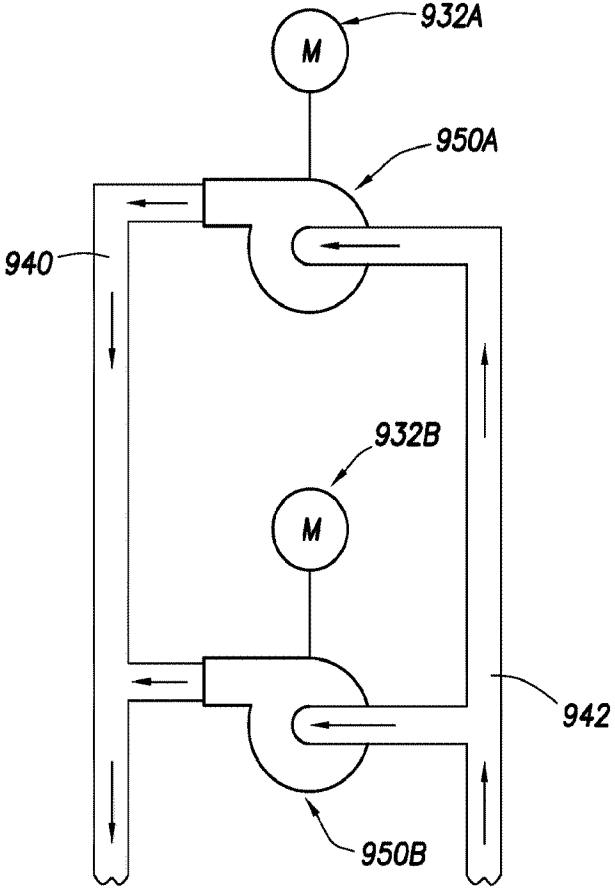
FIGS. 9A and 9B show multiple schematic views of a pumping system in accordance with one or more embodiments of the present disclosure.
Figure 9A:
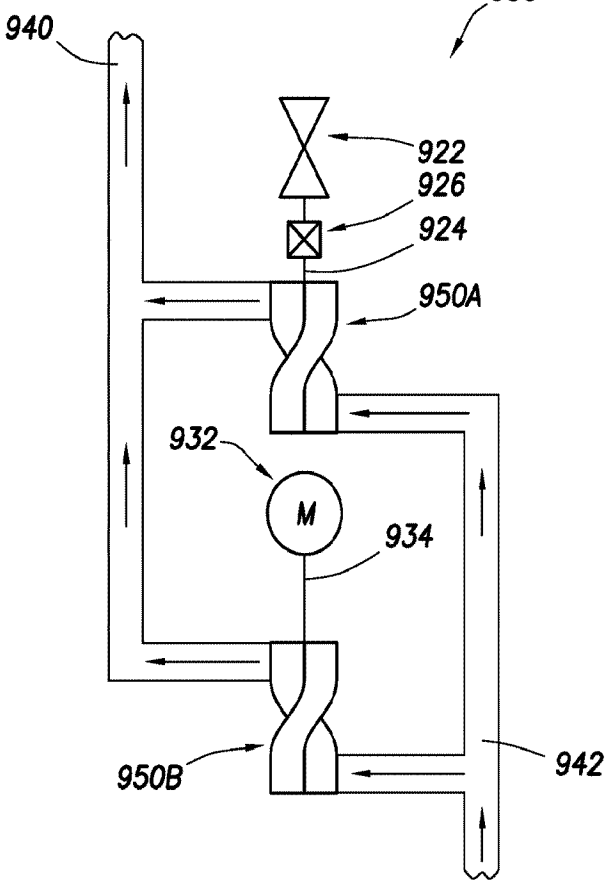

Referring now to FIG. 9A, a schematic view of a pumping system 930 in accordance with embodiments disclosed herein is shown. In this embodiment, the pumping system 930 includes two driving devices 950A and 950B, in which the driving devices 950A and 950B are fluidly coupled to an outlet flow line 940 and an inlet flow line 942. Similar to the driving devices shown in FIG. 8, the driving devices 950A and 950B may also be hydraulic driving devices, and specifically hydraulic pumps, in which the hydraulic pumps may be fluidly coupled to each other in parallel.

Further, the driving device 950A may be coupled to a shaft 924 of a turbine 922, and the driving device 950B may be coupled to a shaft 934 of a motor 932. As such, in this embodiment, a transmission or gearbox 926 may be coupled to the shaft 924 between the turbine 922 and the driving device 950A. This transmission 926 may enable the driving device 950A to modify the ratio and/or direction of rotation and rotational energy translated between the turbine 922 and the driving device 950A. Further, in addition or in alternate to the transmission 926, a clutch (shown as 828 in FIG. 8) may be coupled to the shaft 924 between the turbine 922 and the driving device 950A. This clutch may be used to selectively engage and disengage the shaft 924 and the driving device 950A from each other, as desired.

In accordance with one or more embodiments disclosed herein, rather than only using a turbine coupled to one or more of the driving devices, one or more motors may be used to operate the driving devices of the present disclosure. As shown with reference to FIG. 9B, a schematic view of a pumping system 930 is shown, in which the pumping system 930 uses a first motor 932A and a second motor 932B coupled to the driving devices 950A and 950B, respectively. As such, one or both of the motors 932A and 932B may be electrically coupled to an electrical energy source, thereby enabling the driving devices 950A and 950B to use electrical energy to drive one or more displacement units fluidly coupled thereto.

Figure 10A:
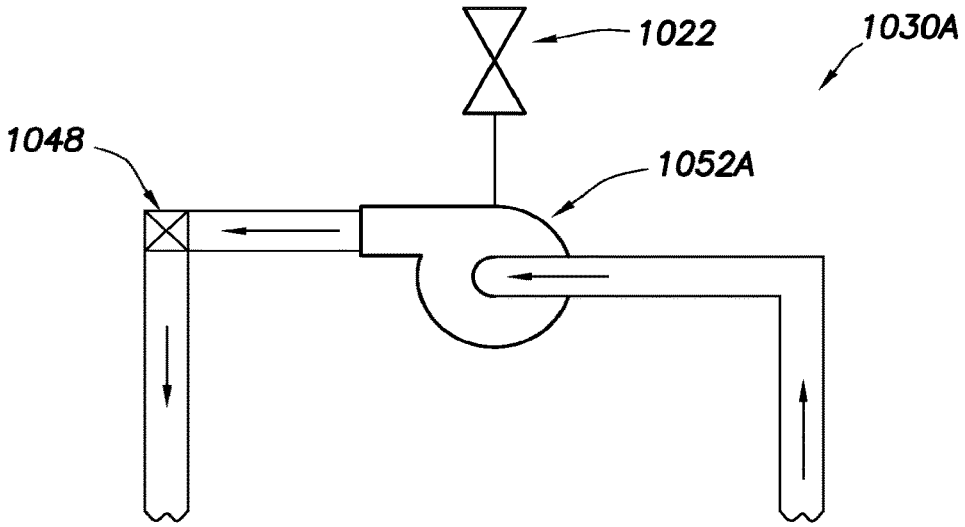
FIGS. 10A and 10B show multiple schematic views of pumping systems in accordance with one or more embodiments of the present disclosure.
Figure 10B:
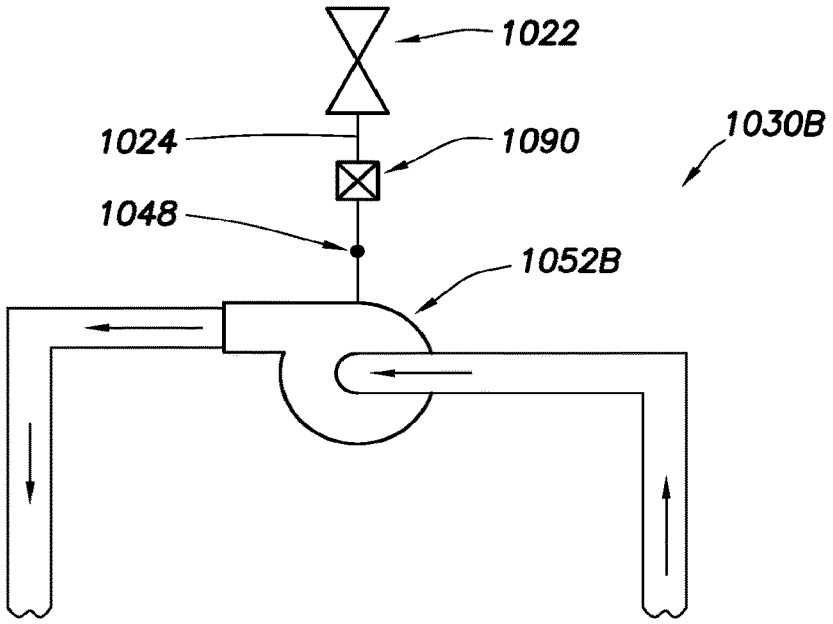

Further, in accordance with one or more embodiments disclosed herein, one or more types of hydraulic pumps, such as a variable displacement hydraulic pump, a variable swash plate hydraulic pump, a fixed output hydraulic pump, or any other type of hydraulic pump known in the art, may be used within the present disclosure. For example, with reference to FIGS. 10A and 10B, multiple schematic views of pumping systems 1030A and 1030B in accordance with one or more embodiments of the present disclosure are shown. In FIG. 10A, a variable swash plate hydraulic pump 1052A may be coupled to a turbine 1022. In such an embodiment, a sensor 1048, such as a flow sensor, may be fluidly coupled to the hydraulic pump 1052A such as to monitor and provide feedback with respect to the hydraulic pump 1052A. In FIG. 10B, a fixed output hydraulic pump 1052B may be coupled to the turbine 1022. In such an embodiment, a controller 1090 may be coupled to the shaft 1024 of the turbine 1022 such as to control the speed and/or direction of the shaft 1024, and a sensor 1048, such as an speed sensor, may be coupled to the shaft 1024 of the turbine 1022 such as to monitor and provide feedback with respect to the turbine 1022. As such, the present disclosure contemplates multiple types and arrangements for hydraulic pumps used in accordance with one or more embodiments disclosed herein.

Furthermore, as discussed above, a driving device in accordance with one or more embodiments disclosed herein may be a hydraulic driving device, such as a hydraulic pump, a mechanical driving device, and/or any other driving device known in the art. As such, with reference to FIGS. 11A and 11B, multiple schematic views of pumping systems 1130A and 1130B in accordance with one or more embodiments of the present disclosure are shown. In these embodiments, the pumping systems 1130A and 1130B are shown as mechanical driving devices, particularly as roller screws 1156A and 1156B. The roller screws 1156A and 1156B may include nuts 1158A and 1158B and threaded shafts 1160A and 1160B, in which the nuts 1158A and 1158B may threadingly engage the threaded shafts 1160A and 1160B.

Figure 11B:
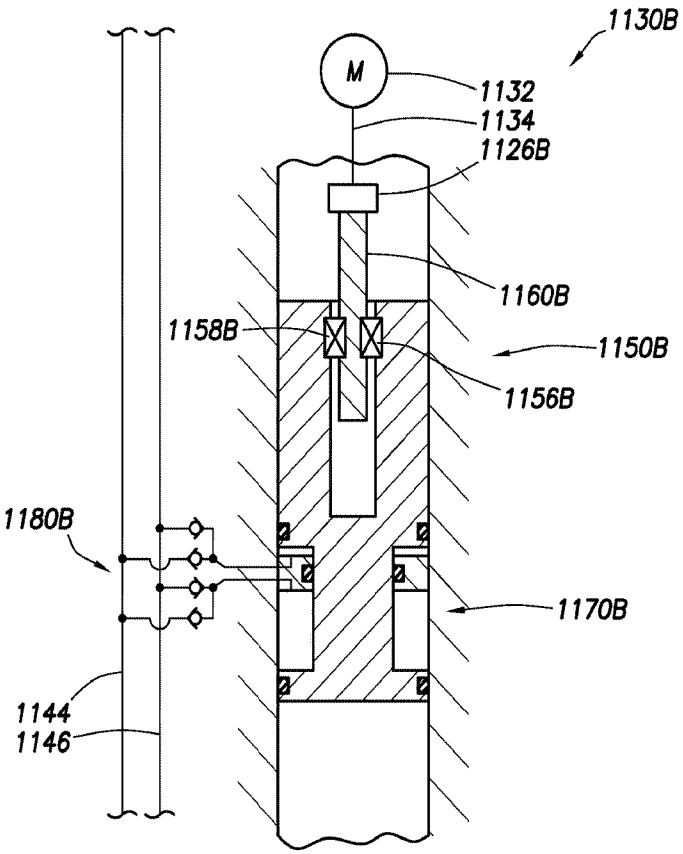
FIGS. 11A and 11B show multiple schematic views of pumping systems in accordance with one or more embodiments of the present disclosure.
Figure 11A:
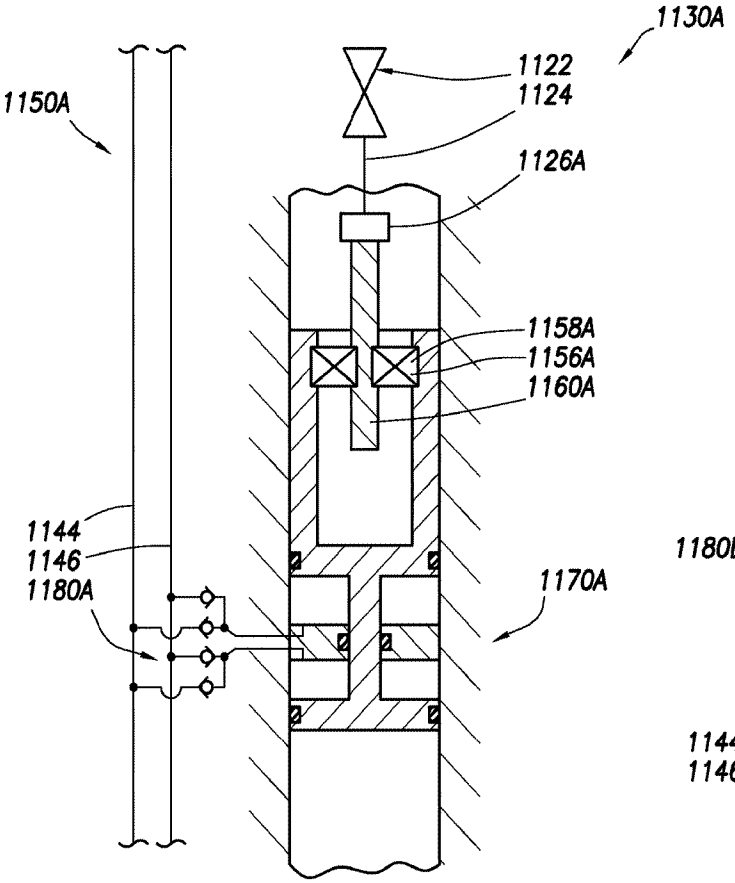

As such, by rotating the threaded shafts 1160A and 1160B, the engagement of the threaded shafts 1160A and 1160B with the nuts 1158A and 1158B may enable the roller screws 1156A and 1156B to drive the displacement units 1170A and 1170B coupled to the roller screws 1156A and 1156B. As the displacement units 1170A and 1170B are driven by the roller screws 1156A and 1156B, the displacement units 1170A and 1170B may receive fluid therein, such as from the inlet flow line 1144 through valve blocks 1180A and 1180B, and the displacement units 1170A and 1170B may displace fluid therefrom, such as into outlet flow line 1146 through the valve blocks 1180A and 1180B. Further, as shown in FIG. 11A, the roller screw 1156A may coupled to the shaft 1124 of the turbine 1122 using a transmission 1126A, and as shown in FIG. 11B, the roller screw 1156B may be coupled to the shaft 1134 of the motor 1132 using a transmission 1126B. Thus, the present disclosure contemplates multiple types and arrangements for one or more driving devices used in accordance with one or more embodiments disclosed herein.

Figure 12:
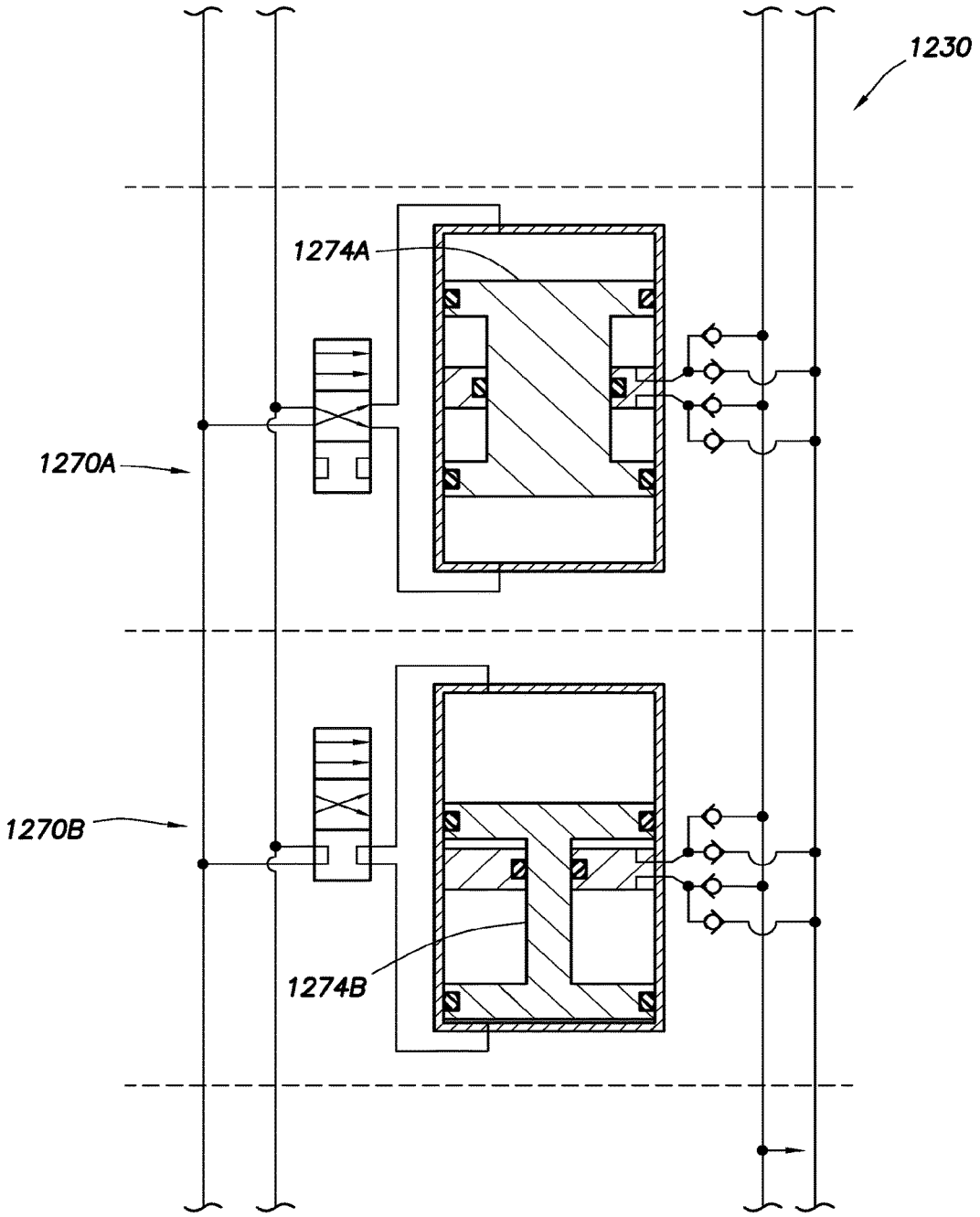
FIG. 12 shows a schematic view of a pumping system in accordance with one or more embodiments of the present disclosure.

In one or more embodiments in accordance with the present disclosure in which more than one displacement unit, the displacement units may be sized and/or arranged such that the displacement units may be configured to receive and/or displace different amounts of fluids with respect to each other. For example, with reference to FIG. 12, a schematic view of a pumping system 1230 having two displacement units 1270A and 1270B in accordance with the present disclosure is shown. In this embodiment, the displacement units 1270A and 1270B may be sized such as to receive different amounts of fluid therein. Particularly, in this embodiment, the piston 1274A of the displacement unit 1270A may be larger than the piston 1274B of the displacement unit 1270B. As such, this arrangement may enable the displacement unit 1270B to receive more fluid therein as compared to the displacement unit 1270A. Thus, those having ordinary skill in the art will appreciate that the displacement units of the present disclosure may be sized and/or arranged to have receive desired amounts of fluid therein and/or have desired flow rates within a pumping system in accordance with embodiments disclosed herein.

Further, in accordance with one or more embodiments disclosed herein, an energy accumulator, such as an electrical energy accumulator (e.g., a battery or a capacitor), a hydraulic energy accumulator (e.g., pressure accumulator bottles), and/or a mechanical energy accumulator (e.g., a flywheel) may be included within the system to provide energy to a pumping system. As such, referring now to FIG. 13, a side view of a system 1320 in accordance with one or more embodiments disclosed herein is shown. Similar to the above shown embodiments, the system 1320 may be included within a drill string, in which the drill string may receive a fluid therein, such as a drilling fluid pumped from the surface into the drill string. In this embodiment, fluid may be received within the system 1320 within an inner bore 1312 of a housing 1382 of the system 1320, such as by having the drilling fluid pumped into a received within the system 1320.

The system 1320 may include a turbine 1322 with a shaft 1324 extending therefrom and coupled thereto, in which the turbine 1322 may be used to convert energy from fluid received by the turbine into rotational energy for the shaft 1324. A clutch 1328 and a gearbox 1326 may also be coupled to the shaft 1324 of the turbine 1322, in which the clutch 1328 may enable the shaft 1324 to be selectively engaged and disengaged from the turbine 1322, as desired, and the gearbox 1326 may be used to modify the ratio and/or direction of rotation and rotational energy translated by the turbine 1322 to the shaft 1324.

Further, the pumping system 1330 may be fluidly coupled to an inlet flow line 1344 and an outlet flow line 1346. In this embodiment, the inlet flow line 1344 may be fluidly coupled to an inlet 1316, such as from a probe from a tool 1314, in which fluid may be received through the inlet flow line 1344 into the pumping system 1330. Further, the outlet flow line 1346 may be fluidly coupled to an exterior of the housing 1382, as shown in this embodiment, in which fluid may be displaced by the pumping system 1330 into the borehole of the formation through the outlet flow line 1346.

In this embodiment, a motor 1332 may be coupled to the shaft 1324 of the turbine 1322, in which the motor 1332 may have a shaft 1334 coupled thereto extending therefrom. A pumping system 1330 may then be coupled to the shaft 1334 extending from the motor 1332. Further, an energy accumulator 1392 may be included within the system 1320, such as by having the energy accumulator coupled to the motor 1332 through a controller 1390.

Figure 13:
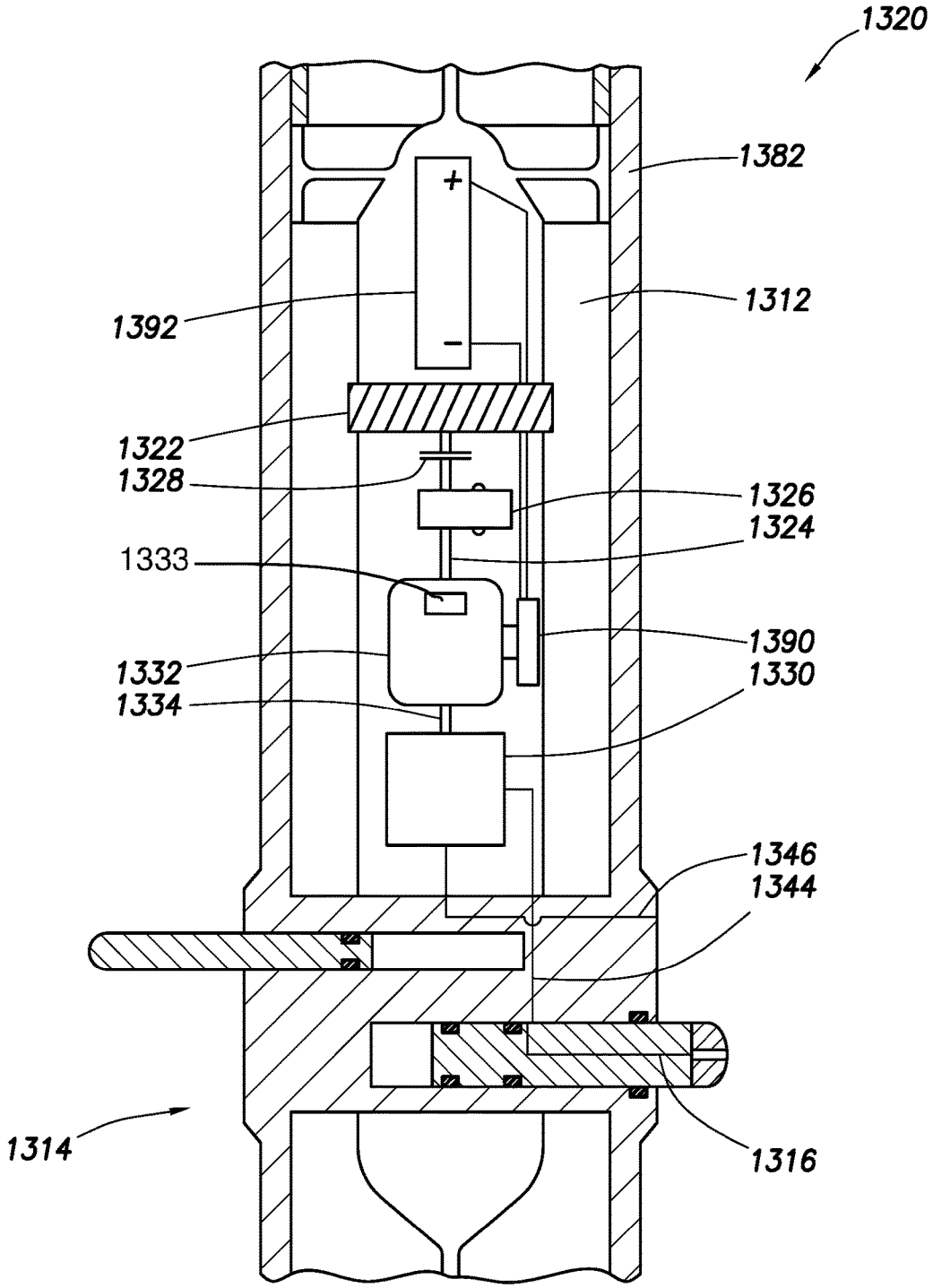
FIG. 13 shows a side view of a system in accordance with one or more embodiments of the present disclosure.

As such, in this embodiment, as the motor 1332 is coupled to the shaft 1324 of the turbine 1322, in which the motor 1332 may be configured to receive rotational energy from the shaft 1324 of the turbine 1322. With this rotational energy, the motor 1332 may then convert the energy to be stored within the energy accumulator 1392, and/or the motor 1332 may use the rotational energy from the shaft 1324 to provide rotational energy to and rotate the shaft 1334 extending from the motor 1332. For example, in one embodiment, the motor 1332 may include an alternator, such as by having an alternator 1333 included therein (as shown in FIG. 13), in which the alternator may be used to convert at least a portion of the rotational energy from the shaft 1324 coupled to the motor 1332 into electrical energy. This electrical energy may then be stored within the energy accumulator 1392 coupled to the motor 1332. The energy accumulator 1392, in this embodiment, may be a battery, or other electrical energy storage device, in which the battery may be used to store, at least temporarily, electrical energy received from the motor 1332.

Thus, in accordance with one or more embodiments of the present disclosure, the pumping system 1330 may be used to pump fluid within the system 1320 and/or other tools fluidly coupled to the pumping system 1330 using the motor 1332. The motor 1332 may provide rotational energy to the shaft 1334 extending therefrom, in which the pumping system 1330 may use rotational energy from the shaft 1334 to pump the fluid therein. As such, to provide rotational energy to the shaft 1334, the motor 1332 may couple the shaft 1334 to the shaft 1324 of the turbine 1322, thereby enabling the motor 1332 to rotate the shaft 1334 using rotational energy from the shaft 1324 from the turbine 1322. Additionally, or alternatively, as the motor 1332 is coupled to the energy accumulator 1392, the motor 1332 may use energy stored within the energy accumulator 1392 to rotate the shaft 1334. This arrangement enables the pumping system 1330 to be driven using energy provided by turbine 1322, such as when the turbine 1322 is in use and is receiving fluid therein, and/or to be driven using energy stored within the energy accumulator 1392, such as when the turbine 1322 may not be in use or additional energy may be needed for driving the pumping system 1330.

As such, the pumping system 1330 may use energy from the turbine 1322 and/or the energy accumulator 1392 to drive the pumping system 1330. In one embodiment, when fluid circulation is present within the system 1320, such as when drilling fluid is pumped into the inner bore 1312, the turbine 1322 may be coupled to the shaft 1334 through the motor 1332, thereby providing rotational energy from the shaft 1324 to the pumping system 1330. In such an embodiment, the motor 1332 may be used to couple the pumping system 1330 to the rotational energy of the shaft 1324 of the turbine 1322, and the motor 1332 may additionally be used to convert rotational energy from the shaft 1324 into energy stored within the energy accumulator 1392.

For example, in an embodiment in which the pumping system 1330 is to be used at a desired flow rate and/or a desired pressure, the motor 1332 may be used to regulate the amount of energy transmitted to the pumping system 1330 from the turbine 1322. If the turbine 1322 is developing and transmitting too much energy to be used by the pumping system 1330, as desired, in which the pumping system 1330 may then be operating at too large of a desired flow rate and/or pressure, the motor 1332 may convert and store a selected amount of energy from the turbine 1322 within the energy accumulator 1392. Further, if the turbine 1322 is not developing and transmitting enough energy to be used by the pumping system 1330, as desired, in which the pumping system 1330 may then be operating at too small of a desired flow rate and/or pressure, the motor 1332 may use energy from the turbine 1322 and the energy accumulator 1392 to drive the pumping system 1330. As such, the system 1320 may be used to regulate the amount of energy used by the pumping system 1330, as desired.

Figure 14:
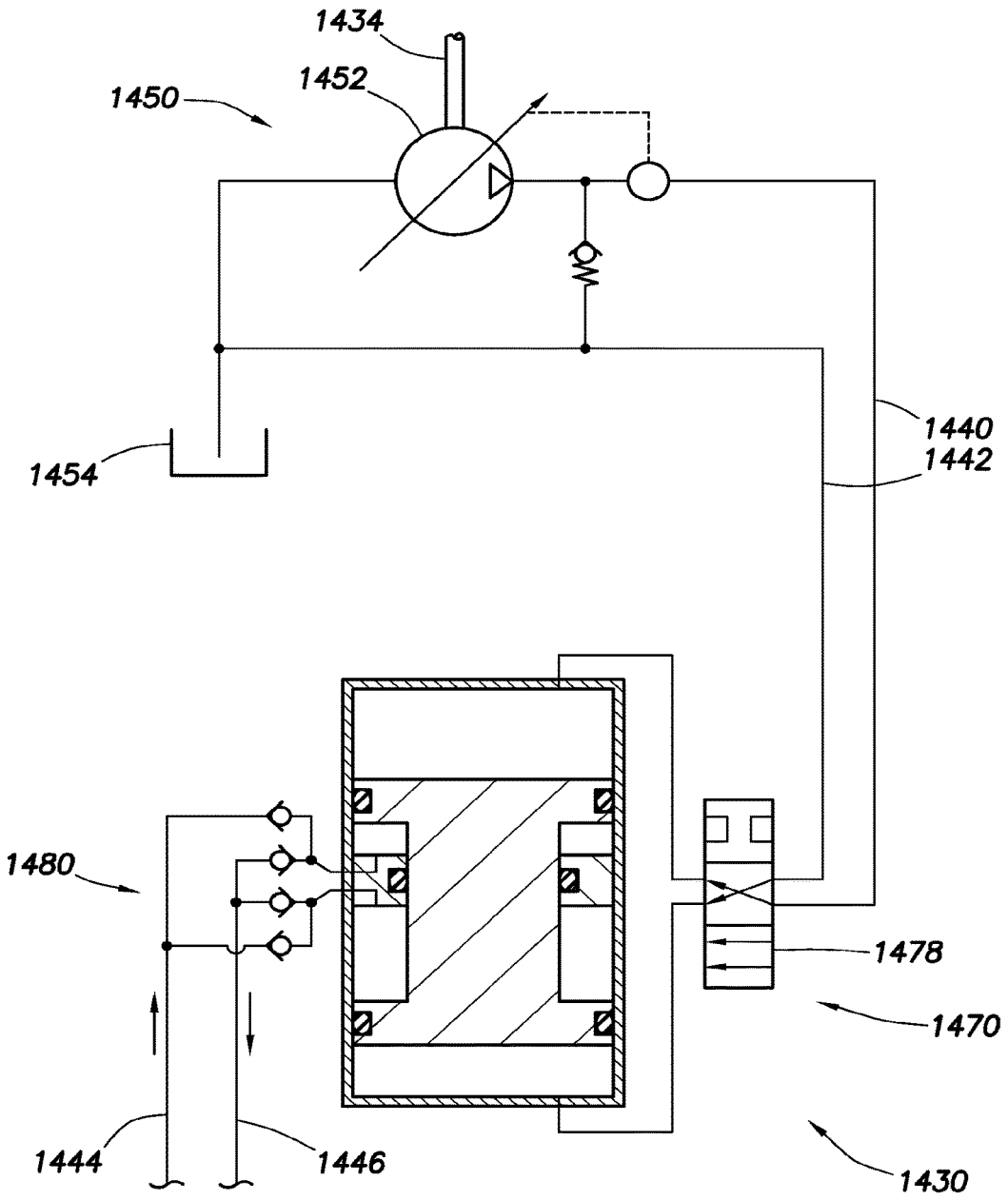
FIG. 14 shows a schematic view of a pumping system in accordance with one or more embodiments of the present disclosure.

Referring now to FIG. 14, a schematic view of a pumping system 1430 in accordance with one or more embodiments disclosed herein is shown. The pumping system 1430 may include a driving device 1450 used to drive a displacement unit 1470, in which, in this embodiment, the driving device 1450 may be coupled to a shaft 1434 of a motor providing rotational energy to the shaft 1434. As shown, the driving device 1450 may be a hydraulic driving device, such as a hydraulic pump 1452. The hydraulic pump 1452 may be fluidly coupled to an outlet flow line 1440 and an inlet flow line 1442, in which the flow lines 1440 and 1442 may be fluidly coupled to the displacement unit 1470. As discussed above, the hydraulic pump 1452 may be used to drive the displacement unit 1470 through a valve 1478, in which fluid, such as hydraulic fluid from a fluid reservoir 1454, may be selectively received and displaced within the displacement unit 1470 using the valve 1478 to drive the displacement unit 1470. Further, the displacement unit 1470 may be fluidly coupled to an inlet flow line 1444 and an outlet flow line 1446 through a valve block 1480, in which fluid may be received into the displacement unit 1470 through the inlet flow line 1444 and may be displaced from the displacement unit 1470 through the outlet flow line 1446.

Figure 15:
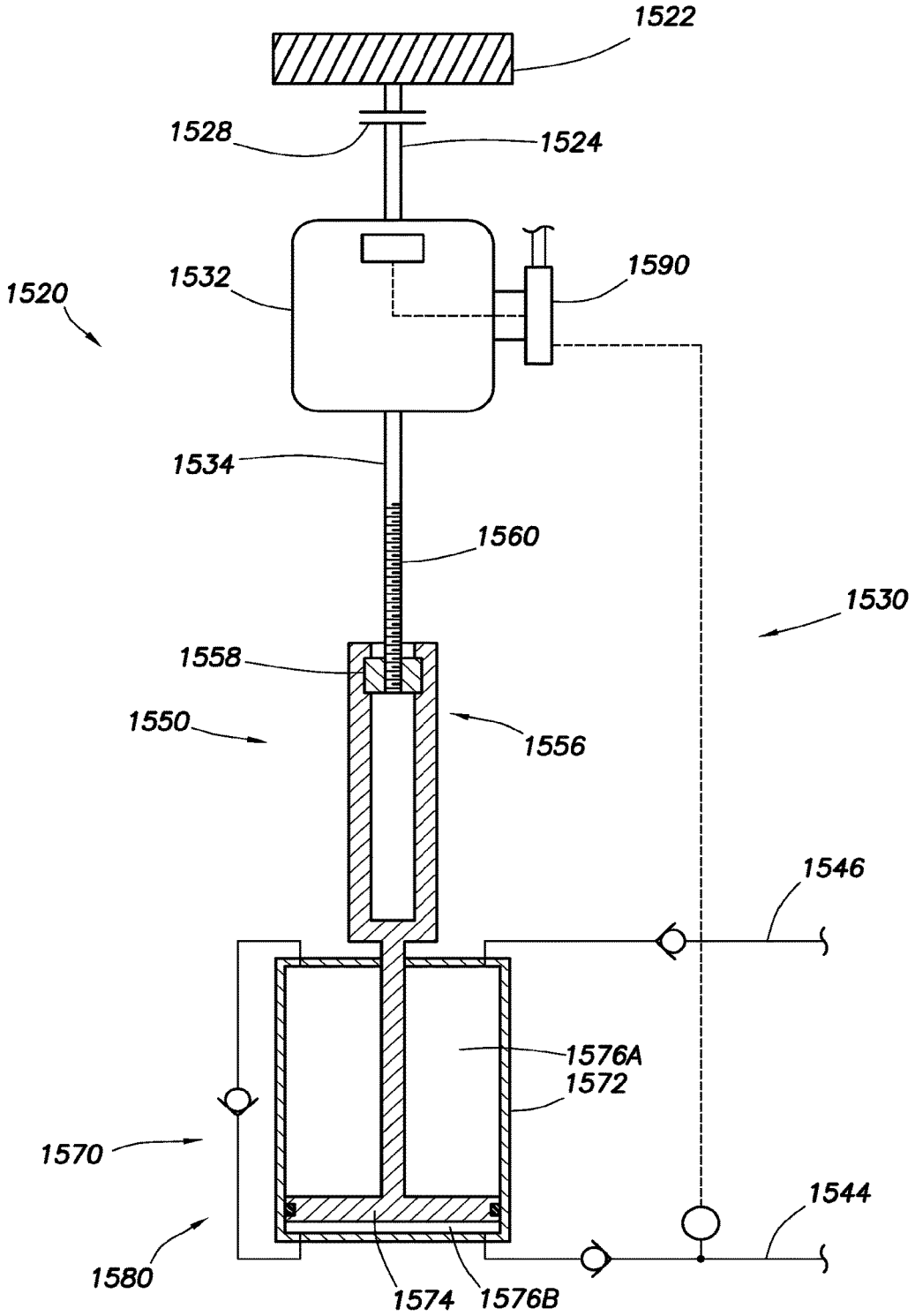
FIG. 15 shows a schematic view of a system used with a pumping system in accordance with one or more embodiments of the present disclosure.

Referring now to FIG. 15, a schematic view of a system 1520 used with a pumping system 1530 in accordance with one or more embodiments disclosed herein is shown. The system 1520 includes a turbine 1522 has a shaft 1524 extending therefrom, in which a motor 1532 is coupled to the shaft 1524. Further, the motor 1532 may have a shaft 1534 extending therefrom, in which the driving device 1550 may be coupled to the shaft 1534 of the motor 1532. As discussed above, the motor 1532 may be used to selectively provide rotational energy to the shaft 1534, thereby enabling the motor 1532 to selectively control the driving device 1550 and the pumping system 1530 coupled to the motor 1532.

As shown, the driving device 1550 may be a mechanical driving device, as previously mentioned, such as a roller screw 1556. The roller screw 1556 may include a nut 1558 and a threaded shaft 1560, in which the threaded shaft 1560 may be coupled to the shaft 1534 extending from the motor 1532. As such, rotational energy may be transmitted from the shaft 1534 of the motor 1532 to the threaded shaft 1560, in which the rotational energy of the threaded shaft 1560 may be used to drive the roller screw 1556 through the nut 1558. As the displacement unit 1570 is coupled to the driving device 1550, the driving device 1550 may be used to drive the displacement device 1570.

For example, as shown, the displacement unit 1550 may include a piston 1574 disposed within a chamber 1572, thereby defining a first cavity 1576A and a second cavity 1576B within the chamber 1572. The first cavity 1576A may be fluidly coupled to an outlet flow line 1546, the second cavity 1576B may be fluidly coupled to an inlet flow line 1544, and the first cavity 1576A and the second cavity 1576B may be fluidly coupled to each other through one or more valves included within flow line 1580. As such, in this embodiment, as the piston 1574 reciprocates within the chamber 1572, fluid may be received within the second cavity 1576B through the inlet flow line 1544, and fluid may be displaced from the first cavity 1576A through the outlet flow line 1546.

For example, as the piston 1574 moves downward within the chamber 1572, fluid within the second cavity 1576B may be displaced from the second cavity 1576B into the first cavity 1576A through the flow line 1580. Then, as the piston 1574 moves upward within the chamber 1572, fluid within the first cavity 1576A may be displaced from the displacement unit 1570 through the outlet flow line 1546, and fluid may be received within the second cavity 1576B through the inlet flow line 1544. As such, to drive the displacement unit 1570, such as within this embodiment, the motor 1532 may selectively use energy from the turbine 1522 and the energy accumulator coupled to the motor to provide energy to the driving device 1550. For example, in one direction, such as in the upward direction, the motor 1532 may be configured to use rotational energy from the shaft 1524 to provide energy to the driving device 1550 to drive the displacement unit 1570. Then, in the other direction, such as in the downward direction, the motor 1532 may be configured to use energy from the energy accumulator, such as through the controller 1590, for the driving device 1550 to drive the displacement unit 1570. In such an embodiment, the motor 1532 may be coupled and de-coupled from the turbine 1522, using the clutch 1528 for example, to enable the motor 1532 to more efficiently provide energy to the driving device 1550.

Figure 16:
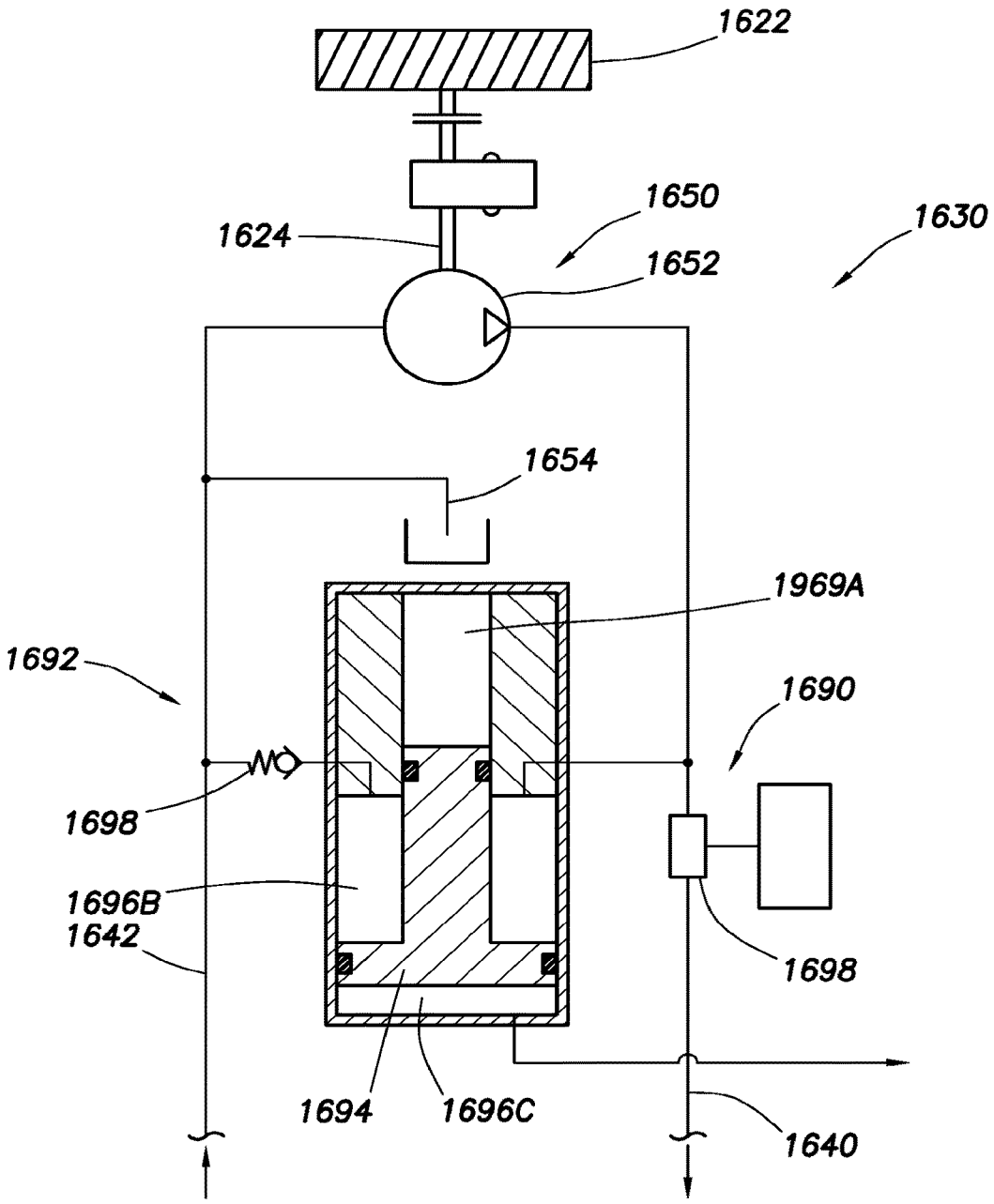
FIG. 16 shows a schematic view of a pumping system in accordance with one or more embodiments of the present disclosure.

As described above, embodiments disclosed herein may include additionally and/or alternatively include a hydraulic energy accumulator. For example, in addition and/or in alternative to an electrical energy accumulator, a hydraulic energy accumulator may also be incorporated within one or more embodiments of the present disclosure. Referring now to FIG. 16 of the present disclosure, a schematic view of a pumping system 1630 in accordance with one or more embodiments disclosed herein is shown. In this embodiment, the pumping system 1630 includes a driving device 1650, particularly a hydraulic pump 1652, in which the hydraulic pump 1652 is coupled to a shaft 1624 of a turbine 1622. The hydraulic pump 1652 may be fluidly coupled to an outlet flow line 1640, in which the hydraulic pump 1652 may pump fluid from a fluid reservoir 1654 into the outlet flow line 1640, and may be fluidly coupled to an inlet flow line 1642, in which the hydraulic pump 1652 and/or the fluid reservoir 1654 may receive fluid from the inlet flow line 1642.

Further, an energy accumulator 1692, and specifically a hydraulic energy accumulator, is included within the pumping system 1630 in this embodiment. As shown, the hydraulic energy accumulator may include a piston 1694 disposed therein, in which the piston 1694 may be used to define multiple cavities within the hydraulic energy accumulator. In this embodiment, the hydraulic energy accumulator may include a first cavity 1696A, a second cavity 1696B, and/or a third cavity 1696C, as desired. As such, the second cavity 1696B in this embodiment may be fluidly coupled to the outlet flow line 1640, in which the controller 1690 may be used to selectively have fluid received within and displaced by the second cavity 1696B. For example, when the hydraulic pump 1652 is pumping fluid through the outlet flow line 1640 above a desired flow rate and/or a desired pressure, the controller 1690 and the valve 1648 may be used to restrict flow past the valve 1648 such that fluid flows, at least partially, within the second cavity 1696B of the hydraulic energy accumulator.

As the second cavity 1696B fills with fluid and expands, the piston 1694 may move in the downward direction, as shown, in which the second cavity may develop a higher pressure than the first cavity 1696A. For example, the first cavity 1696A may be disposed at atmospheric pressure initially, and then as the first cavity 1696A expands, the pressure of the first cavity 1696A may begin to decrease. As such, the hydraulic energy accumulator may store energy therein by the second cavity 1696B having a higher pressure than the first cavity 1696A. Then, as desired, the hydraulic energy accumulator may release the stored energy therein, such as by using the controller 1690 and the valve 1698, in which the piston 1694 may move in upward to displace fluid within the second cavity 1696B into the outlet flow line 1640. The controller 1690 and the valve 1698 may, thus, be used to regulate the fluid flow rate and/or pressure through the outlet flow line 1640, in which the hydraulic energy accumulator may be used to store energy from the flow line 1640 therein and/or provide energy to the flow line 1640, each as desired. The outlet flow line 1640 may then be fluidly coupled to a displacement unit, downhole tool, and/or downhole motor, thereby enabling the pumping system 1630 to drive a displacement unit or other tools fluidly coupled thereto.

In accordance with one or more embodiments of the present disclosure, one or more valves, such as relief valves, may be included within the pumping system and fluidly coupled to one or more components of the pumping system. For example, as shown in FIG. 8, a valve 898 may be coupled to one or both of the flow lines 840 and 842, and a shown in FIG. 16, a valve 1698 may be coupled to the energy accumulator 1692 and the flow line 1642. As such, one or more other valves may be included within the pumping system to provide fluid relief thereto and/or direct the flow of the fluid, as desired.

Further, one or more sensors may be included within the pumping system to measure one or more characteristics of the pumping system. For example, as shown in FIG. 10B, a sensor 1048 may be coupled to the shaft 1024, thereby enabling the sensor 1048 to measure characteristics of the shaft 1024, and as shown in FIG. 16, a sensor 1648 may be coupled to the flow line 1640 to measure characteristics of the flow line 1640. As such, one or more sensors may be included within the system to measure pressure, temperature, flow rate, viscosity, speed, and/or any other characteristic of the system known in the art.

Furthermore, in accordance with one or more embodiments of the present disclosure, one or more controllers, such as those shown as 1090, 1390, 1590, and 1690, may be used within the system. A controller may be operatively coupled to one or more components of the pumping system to receive feedback from the components and/or to control the components. For example, the controller may be operatively coupled to the switch valve, the gear box, the motor, the alternator, the clutch, the brake, the hydraulic motor, the valves, the relief valves, the sensors, and/or any other components of the system to provide further control of the system, as desired.

Embodiments disclosed herein may provide for one or more of the following advantages. A system in accordance with the present disclosure may be included within one or more of the embodiments shown in FIGS. 1-6, in addition to being included within other tools and/or devices that may be disposed downhole within a formation. The system, thus, may be used within a tool to selectively provide power to a pumping system within the tool, as desired. For example, a system in accordance with one or more embodiments disclosed herein may be used to drive one or more displacement units using a turbine and/or an electric motor. As such, depending on the requirements needed for driving the one or more displacement units, such as the desired flow rate for the system, the turbine and/or the electric motor may be used to drive the displacement units.

Further, a system in accordance with one or more embodiments disclosed herein may provide redundancy within the pumping system. For example, in an embodiment in which a turbine fails and/or a motor fails, the other of the turbine and the motor may be used, at least temporarily, to drive the pumping system within a tool. Furthermore, a system in accordance with one or more embodiments disclosed herein may be used to regulate a flow rate, pressure, and/or energy consumption used by a pumping system. For example, in an embodiment in which an energy accumulator is included therein, the energy accumulator may selectively receive energy and/or dispose of energy to regulate the operation of a pumping system.

In accordance with one aspect of the present disclosure, one or more embodiments disclosed herein relate to a system to power a pumping system within a downhole tool. The system includes a turbine having a shaft extending therefrom, the turbine configured to convert energy from a first fluid received therein into rotational energy output at the shaft, and the pumping system coupled to the shaft of the turbine. The pumping system includes at least one displacement unit having a cavity formed therein, the cavity configured to receive a second fluid therein, a first driving device coupled to the shaft of the turbine, the first driving device configured to drive the at least one displacement unit such that the second fluid is received within the cavity, and a second driving device coupled to a motor, the second driving device configured to drive the at least one displacement unit such that the second fluid is received within the cavity.

In accordance with another aspect of the present disclosure, one or more embodiments disclosed herein relate to a system to power a pumping system within a downhole tool. The system includes a turbine having a shaft extending therefrom, the turbine configured to convert energy from a first fluid received therein into rotational energy output at the shaft, and a displacement unit having a cavity formed therein, the cavity configured to receive a second fluid therein. The system further includes an energy accumulator configured to receive, at least a portion of, rotational energy from the shaft of the turbine and store energy therein, and a driving device configured to couple to the shaft of the turbine and configured to drive the displacement unit such that the second fluid is received within the cavity using at least one of rotational energy received from the turbine and energy stored within the energy accumulator.

In accordance with another aspect of the present disclosure, one or more embodiments disclosed herein relate to a method to manufacture a system to be used to power a pumping system within a downhole tool. The method includes providing a turbine having a shaft extending therefrom, the turbine configured to convert energy from a first fluid received therein into rotational energy for the shaft, and providing at least one displacement unit having a cavity formed therein, the cavity configured to receive a second fluid therein. The method further includes coupling a first driving device to the shaft of the turbine such that the first driving device is configured to drive the at least one displacement unit and the second fluid is received with the cavity of the at least one displacement unit, and coupling a second driving device to an electric motor such that the second driving device is configured to drive the at least one displacement unit and the second fluid is received within the cavity of the at least one displacement unit.

In accordance with another aspect of the present disclosure, one or more embodiments disclosed herein relate to a method to manufacture a system to be used to power a pumping system within a downhole tool. The method includes providing a turbine having a shaft extending therefrom, the turbine configured to convert energy from a first fluid received therein into rotational energy for the shaft, providing a displacement unit having a cavity formed therein, the cavity configured to receive a second fluid therein, and configuring a driving device to couple to the shaft of the turbine such that rotational energy from the shaft of the turbine is received by the driving device. The method further includes configuring an energy accumulator to receive rotational energy from the shaft of the turbine and store energy therein, and coupling the driving device to drive the displacement unit such that the second fluid is received with the cavity of the displacement unit using at least one of rotational energy received from the turbine by the driving device and energy stored within the energy accumulator.

Further, in accordance with another aspect of the present disclosure, one or more embodiments disclosed herein relate to a method to power a pumping system within a downhole tool. The method includes disposing downhole a turbine having a shaft extending therefrom, the turbine configured to receive a first fluid, at least one displacement unit having a cavity formed therein, the cavity configured to receive a second fluid therein, and at least one driving device coupled to the shaft of the turbine, and pumping a first fluid downhole such that the first fluid is received within the turbine. The method further includes converting energy from the first fluid pumped into the turbine into rotational energy for the shaft extending from the turbine, and driving the at least one displacement unit to receive the second fluid therein with the at least one driving device, the at least one driving device driving the at least one displacement unit with rotational energy from the shaft of the turbine.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a tubing string; and a downhole tool coupled to and conveyable with the tubing string within a wellbore that extends into a subterranean formation, wherein the downhole tool comprises:

an inlet in selective fluid communication with the wellbore or the subterranean formation;

an inlet flow line fluidly coupled to the inlet;

an outlet flow line fluidly coupled to an exterior of the downhole tool;

a pumping system coupled between the inlet flow line and the outlet flow line;

an energy accumulator;

a turbine operable to receive a first fluid from the tubing string and convert energy received via the first fluid into rotational energy; and a motor operable to:

receive rotational energy from the turbine;

convert at least a portion of the rotational energy received from the turbine into energy that is subsequently stored by the energy accumulator when the turbine develops more energy than can be used by the pumping system;

receive and convert energy from the energy accumulator into rotational energy; and drive the pumping system to pump a second fluid from the inlet flow line to the outlet flow line by imparting, to the pumping system:

rotational energy received from the turbine; and rotational energy converted from energy received from the energy accumulator.

2. The apparatus of claim 1 wherein the downhole tool further comprises a clutch selectively modifying rotation and/or rotational energy transferred from the turbine to the motor.

3. The apparatus of claim 1 wherein the downhole tool further comprises a gearbox selectively modifying direction and/or ratio of rotation and/or rotational energy transferred from the turbine to the motor.

4. The apparatus of claim 1 wherein the downhole tool further comprises a clutch and a gearbox, wherein:

the clutch selectively modifies rotation and/or rotational energy transferred from the turbine to the gearbox; and the gearbox selectively modifies direction and/or ratio of rotation and/or rotational energy transferred from the clutch to the motor.

5. The apparatus of claim 1 wherein the downhole tool further comprises a probe comprising the inlet.

6. The apparatus of claim 5 wherein the probe is selectively extendable away from the downhole tool into contact with a sidewall of the wellbore adjacent the subterranean formation.

7. The apparatus of claim 6 wherein the second fluid is fluid pumped from the subterranean formation through the probe and into the inlet flow line in response to the motor driving the pumping system.

8. The apparatus of claim 1 wherein the downhole tool further comprises a plurality of packers each expandable into contact with a sidewall of the wellbore adjacent the subterranean formation, wherein the inlet is a port of the downhole tool positioned between ones of the plurality of packers.

9. The apparatus of claim 8 wherein the second fluid is fluid pumped from the subterranean formation into an interval of the wellbore sealed by the plurality of packers, and then through the port and into the inlet flow line in response to the motor driving the pumping system.

10. The apparatus of claim 1 wherein the motor comprises an alternator operable to convert at least a portion of the rotational energy received from the turbine into electrical energy.

11. The apparatus of claim 10 wherein the energy accumulator is or comprises an electrical energy storage device.

12. An apparatus, comprising:

a tubing string; and a downhole tool coupled to and conveyable with the tubing string within a wellbore that extends into a subterranean formation, wherein the downhole tool comprises:

an inlet in selective fluid communication with the wellbore or the subterranean formation;

an inlet flow line fluidly coupled to the inlet;

an outlet flow line fluidly coupled to an exterior of the downhole tool;

a pumping system coupled between the inlet flow line and the outlet flow line;

an energy accumulator comprising an electrical energy storage device;

a turbine operable to receive a first fluid from the tubing string and convert energy received via the first fluid into rotational energy;

a motor comprising an alternator, wherein the motor is operable to receive rotational energy from the turbine, the alternator is operable to convert at least a portion of the rotational energy received from the turbine into electrical energy that is subsequently stored by the electrical energy storage device of the energy accumulator when the turbine develops more energy than can be used by the pumping system, and the motor is further operable to;

receive and convert energy from the energy accumulator into rotational energy; and drive the pumping system to pump a second fluid from the inlet flow line to the outlet flow line by imparting, to the pumping system:

rotational energy received from the turbine; and rotational energy converted from energy received from the energy accumulator; and a clutch and a gearbox, wherein the clutch selectively modifies rotation and/or rotational energy transferred from the turbine to the gearbox, and the gearbox selectively modifies direction and/or ratio of rotation and/or rotational energy transferred from the clutch to the motor.

13. The apparatus of claim 12 wherein the downhole tool further comprises a probe comprising the inlet.

14. The apparatus of claim 13 wherein the probe is selectively extendable away from the downhole tool into contact with a sidewall of the wellbore adjacent the subterranean formation.

15. The apparatus of claim 14 wherein the second fluid is fluid pumped from the subterranean formation through the probe and into the inlet flow line in response to the motor driving the pumping system.

16. The apparatus of claim 12 wherein the downhole tool further comprises a plurality of packers each expandable into contact with a sidewall of the wellbore adjacent the subterranean formation, wherein the inlet is a port of the downhole tool positioned between ones of the plurality of packers.

17. The apparatus of claim 16 wherein the second fluid is fluid pumped from the subterranean formation into an interval of the wellbore sealed by the plurality of packers, and then through the port and into the inlet flow line in response to the motor driving the pumping system.

* * * * *